US010762907B2

(12) United States Patent
Tomasek et al.

(10) Patent No.: US 10,762,907 B2
(45) Date of Patent: Sep. 1, 2020

(54) APPARATUS AND METHOD FOR IMPROVING A TRANSITION FROM A CONCEALED AUDIO SIGNAL PORTION TO A SUCCEEDING AUDIO SIGNAL PORTION OF AN AUDIO SIGNAL

(71) Applicant: Fraunhofer-Gesellschaft zur Förderung der angewandten Forschung e.V., Munich (DE)

(72) Inventors: Adrian Tomasek, Zirndorf (DE); Jérémie LeComte, Santa Clara, CA (US)

(73) Assignee: Fraunhofer-Gesellschaft zur Förderung der angewandten Forschung e.V., Munich (DE)

( * ) Notice: Subject to any disclaimer, the term of this patent is extended or adjusted under 35 U.S.C. 154(b) by 209 days.

(21) Appl. No.: 16/048,166

(22) Filed: Jul. 27, 2018

(65) Prior Publication Data

US 2019/0122672 A1 Apr. 25, 2019

Related U.S. Application Data

(63) Continuation of application No. PCT/EP2017/051623, filed on Jan. 26, 2017, which is (Continued)

(30) Foreign Application Priority Data

Jan. 29, 2016 (EP) ..... 16153409

(51) Int. Cl.
*G10L 19/005* (2013.01)
*G10L 19/12* (2013.01)
(Continued)

(52) U.S. Cl.
CPC ..... *G10L 19/005* (2013.01); *G10L 19/12* (2013.01); *G10L 19/26* (2013.01); *G10L 21/04* (2013.01)

(58) Field of Classification Search
CPC ..... G10L 19/005
(Continued)

(56) References Cited

U.S. PATENT DOCUMENTS 5,327,498 A 7/1994 Hamon
8,543,392 B2 9/2013 Oshikiri et al.
(Continued)

FOREIGN PATENT DOCUMENTS

EP 0363233 B1 11/1994
JP 2010034630 A 2/2010
(Continued)

OTHER PUBLICATIONS

"AAC-ELD Standard", AAC-ELD Standard: http://www.iso.org/iso/iso_catalogue/catalogue_tc/catalogue_detail.htm?csnumber=46457 ISO/IEC 14496-3:200X(E), Contents for Subpart 4, 2009, 405 pages.
(Continued)

*Primary Examiner* — Susan I McFadden
(74) *Attorney, Agent, or Firm* — Michael A. Glenn; Perkins Coie LLP

(57) ABSTRACT

An apparatus for improving a transition from a concealed audio signal portion is provided. The apparatus includes a processor being configured to generate a decoded audio signal portion of the audio signal. The processor is configured to generate the decoded audio signal portion using the first sub-portion of the first audio signal portion and using the second audio signal portion or a second sub-portion of the second audio signal portion, such that for each sample of two or more samples of the second audio signal portion, the
(Continued)

sample position of the sample of the two or more samples of the second audio signal portion is equal to the sample position of one of the samples of the decoded audio signal portion.

43 Claims, 15 Drawing Sheets

Related U.S. Application Data a continuation of application No. PCT/EP2016/060776, filed on May 12, 2016.

(51) Int. Cl.
*G10L 19/26* (2013.01)
*G10L 21/04* (2013.01)

(58) Field of Classification Search
USPC ..... 704/219
See application file for complete search history.

(56) References Cited

U.S. PATENT DOCUMENTS

| | | | | |
|---|---|---|---|---|
| 8,731,913 | B2 * | 5/2014 | Zopf | G10L 19/005 704/207 |
| 9,478,220 | B2 * | 10/2016 | Sung | G10L 19/005 |
| 9,881,621 | B2 * | 1/2018 | Huang | G10L 19/005 |
| 9,997,167 | B2 * | 6/2018 | Reuschl | H04J 3/0632 |
| 10,431,230 | B2 * | 10/2019 | Schnell | G10L 19/0212 |
| 2005/0044471 | A1 | 2/2005 | Chia et al. | |
| 2006/0271359 | A1 | 11/2006 | Khalil et al. | |
| 2007/0198254 | A1 | 8/2007 | Goto et al. | |
| 2008/0046233 | A1 | 2/2008 | Chen et al. | |
| 2011/0022924 | A1 | 1/2011 | Malenovsky et al. | |
| 2011/0125505 | A1 | 5/2011 | Vaillancourt et al. | |
| 2011/0208517 | A1 | 8/2011 | Zopf | |
| 2012/0010882 | A1 | 1/2012 | Thyssen et al. | |

FOREIGN PATENT DOCUMENTS

| | | | |
|---|---|---|---|
| JP | 2010530078 | A | 9/2010 |
| RU | 2488897 | C1 | 7/2013 |
| WO | 2003/043277 | A1 | 5/2003 |
| WO | 2005086138 | A1 | 9/2005 |
| WO | 2006/130236 | A2 | 12/2006 |
| WO | 2007/073604 | A1 | 7/2007 |
| WO | 2006/130236 | A3 | 2/2008 |
| WO | 2015/063045 | A1 | 5/2015 |

OTHER PUBLICATIONS

Chibani, Mohamed et al., "Resynchronization of the Adaptive Codebook in a Constrained CELP Codec after a Frame Erasure", 2006 International Conference on Acoustics, Speech and Signal Processing (ICASSP'2006), Mar. 14-19, 2006, pp. I-13 through I-16.

Gournay, Philippe, "Improved Frame Loss Recovery Using Closed-Loop Estimation of Very Low Bit Rate Side Information", Interspeech, Sep. 22-26, 2008, pp. 666-669.

Lecomte, Jeremie et al., "Enhanced Time Domain Packet Loss Concealment in Switched Speech/Audio Codec", IEEE ICASSP, Brisbane, Australia, this paper describes new time domain techniques for concealing packet loss in the new 3GPP Enhanced Voice Services codec, Apr. 2015, pp. 5922-5926.

Moulines, Eric et al., "Non-parametric techniques for pitch-scale and time-scale modification of speech", Speech Communication, vol. 16, 1995, pp. 175-205.

Ryu, Sang-Uk et al., "Encoder assisted frame loss concealment for MPEG-AAC decoder", ICASSP IEEE Int. Conf. Acoust. Speech Signal Process Proc., vol. 5, May 2006, pp. V-169 to V-172.

Schnell, Markus et al., "MPEG-4 Enhanced Low Delay AAC—a new standard for high quality communication", Audio Engineering Society: 125th Audio Engineering Society Convention 2008; Oct. 2-5, 2008, pp. 1-14.

* cited by examiner

APPARATUS AND METHOD FOR IMPROVING A TRANSITION FROM A CONCEALED AUDIO SIGNAL PORTION TO A SUCCEEDING AUDIO SIGNAL PORTION OF AN AUDIO SIGNAL

CROSS-REFERENCE TO RELATED APPLICATIONS

This application is a continuation of copending International Application No. PCT/EP2017/051623, filed Jan. 26, 2017, which is incorporated herein by reference in its entirety, and additionally claims priority from European Application No. 16153409.4, filed Jan. 29, 2016, and International Application No. PCT/EP2016/060776, filed May 12, 2016, which are all incorporated herein by reference in their entirety.

The present invention relates to audio signal processing and decoding, and, in particular, to an apparatus and method for improving a transition from a concealed audio signal portion to a succeeding audio signal portion of an audio signal.

BACKGROUND OF THE INVENTION

In case of an error-prone network, every codec is trying to mitigate the artifacts due to those losses. The state of the art focuses on concealing the lost information by means of different methods, from simple muting or noise substitution to advanced methods such as prediction based on past good frames. One clearly overlooked great source of artifacts due to packet losses is located at the recovery (few good frames after a loss).

Due to the long term prediction often used in the case of speech codecs, the recovery artifact could be really severe and the error propagation could impact multiple following good frames. Some conventional technology tries to mitigate that problem, see, e.g., [1] and [2].

In the case of generic or audio codecs (any codec working in the transform domain), a lot of documentation about the concealment of frame losses like in [3] can be found. However, the available conventional technology does not focus on the recovery of frames. It is assumed that due to the nature of transform domain codec that the overlap and add will smooth out the transition artifacts. One good example is AAC-ELD (AAC-ELD=Advanced Audio Coding–Enhanced low delay; see [4]) used in Facetime for communication on IP network.

The first few frames after a frame loss are referred to as "recovery frames". Conventional transform domain codecs do not appear to provide a special handling regarding the one or more recovery frames. Sometimes, annoying artifacts occur. An example for a problem that can happen when conducting recovery is a superposition of the concealed and of the good wave signal in the overlap and add part, which sometimes leads to annoying energy boosts.

Another problem is abrupt pitch changes on frame borders. An example for the case of speech signals is that when the pitch of the original signal changes and a frame loss occurs, the concealment method might predict the pitch at the end of a frame slightly wrong. This slightly wrong prediction might cause a jump of the pitch into the next good frame. Most of the known concealment methods do not even use prediction and only use a fix pitch base on the last valid pitch what could result in an even bigger mismatch with the first good frame. Some other methods use advanced prediction to reduce the drift, see, for example, TD-TCX PLC (TD=Time domain; TCX=Transform Coded Excitation; PLC=Packet Loss Concealment) in EVS (EVS=Enhanced Voice Services), see [5].

State of the art methods for modifying the pitch in a speech signal, such as TD-PSOLA (TD-PSOLA=Time Domain—Pitch Synchronous Overlap-Add), see [6] and [7], conduct prosody modifications on the speech signal, such as duration expansion/contraction (known as time-stretching) or conduct changing the fundamental frequency (the pitch). This is done, by decomposing a speech signal into short-term and pitch-synchronous analysis signals that are then repositioned on the time axis and juxtaposed progressively. However, the signal in the recovery frame is destroyed after the overlapping mechanism, when the pitch in the concealed frame and the pitch in the original signal differ. The TD-PSOLA mechanism would just reposition the artefact on the time axes, what is not suitable for recovery.

SUMMARY

According to an embodiment, an apparatus for improving a transition from a concealed audio signal portion of an audio signal to a succeeding audio signal portion of the audio signal may have: a processor being configured to generate a decoded audio signal portion of the audio signal depending on a first audio signal portion and depending on a second audio signal portion, wherein the first audio signal portion depends on the concealed audio signal portion, and wherein the second audio signal portion depends on the succeeding audio signal portion, and an output interface for outputting the decoded audio signal portion, wherein each of the first audio signal portion and of the second audio signal portion and of the decoded audio signal portion includes a plurality of samples, wherein each of the plurality of samples of the first audio signal portion and of the second audio signal portion and of the decoded audio signal portion is defined by a sample position of a plurality of sample positions and by a sample value, wherein the plurality of sample positions is ordered such that for each pair of a first sample position of the plurality of sample positions and a second sample position of the plurality of sample positions, being different from the first sample position, the first sample position is either a successor or a predecessor of the second sample position, wherein the processor is configured to determine a first sub-portion of the first audio signal portion, such that the first sub-portion includes fewer samples than the first audio signal portion, and wherein the processor is configured to generate the decoded audio signal portion using the first sub-portion of the first audio signal portion and using the second audio signal portion or a second sub-portion of the second audio signal portion, such that for each sample of two or more samples of the second audio signal portion, the sample position of said sample of the two or more samples of the second audio signal portion is equal to the sample position of one of the samples of the decoded audio signal portion, and such that the sample value of said sample of the two or more samples of the second audio signal portion is different from the sample value of said one of the samples of the decoded audio signal portion.

According to another embodiment, a method for improving a transition from a concealed audio signal portion of an audio signal to a succeeding audio signal portion of the audio signal may have the steps of: generating a decoded audio signal portion of the audio signal depending on a first audio signal portion and depending on a second audio signal portion, wherein the first audio signal portion depends on the concealed audio signal portion, and wherein the second audio signal portion depends on the succeeding audio signal portion, and outputting the decoded audio signal portion, wherein each of the first audio signal portion and of the second audio signal portion and of the decoded audio signal portion includes a plurality of samples, wherein each of the plurality of samples of the first audio signal portion and of the second audio signal portion and of the decoded audio signal portion is defined by a sample position of a plurality of sample positions and by a sample value, wherein the plurality of sample positions is ordered such that for each pair of a first sample position of the plurality of sample positions and a second sample position of the plurality of sample positions, being different from the first sample position, the first sample position is either a successor or a predecessor of the second sample position, wherein generating the decoded audio signal includes determining a first sub-portion of the first audio signal portion, such that the first sub-portion includes fewer samples than the first audio signal portion, wherein generating the decoded audio signal portion is conducted using the first sub-portion of the first audio signal portion and using the second audio signal portion or a second sub-portion of the second audio signal portion, such that for each sample of two or more samples of the second audio signal portion, the sample position of said sample of the two or more samples of the second audio signal portion is equal to the sample position of one of the samples of the decoded audio signal portion, and such that the sample value of said sample of the two or more samples of the second audio signal portion is different from the sample value of said one of the samples of the decoded audio signal portion.

Another embodiment may have a non-transitory digital storage medium having a computer program stored thereon to perform the method for improving a transition from a concealed audio signal portion of an audio signal to a succeeding audio signal portion of the audio signal, the method having the steps of: generating a decoded audio signal portion of the audio signal depending on a first audio signal portion and depending on a second audio signal portion, wherein the first audio signal portion depends on the concealed audio signal portion, and wherein the second audio signal portion depends on the succeeding audio signal portion, and outputting the decoded audio signal portion, wherein each of the first audio signal portion and of the second audio signal portion and of the decoded audio signal portion includes a plurality of samples, wherein each of the plurality of samples of the first audio signal portion and of the second audio signal portion and of the decoded audio signal portion is defined by a sample position of a plurality of sample positions and by a sample value, wherein the plurality of sample positions is ordered such that for each pair of a first sample position of the plurality of sample positions and a second sample position of the plurality of sample positions, being different from the first sample position, the first sample position is either a successor or a predecessor of the second sample position, wherein generating the decoded audio signal includes determining a first sub-portion of the first audio signal portion, such that the first sub-portion includes fewer samples than the first audio signal portion, wherein generating the decoded audio signal portion is conducted using the first sub-portion of the first audio signal portion and using the second audio signal portion or a second sub-portion of the second audio signal portion, such that for each sample of two or more samples of the second audio signal portion, the sample position of said sample of the two or more samples of the second audio signal portion is equal to the sample position of one of the samples of the decoded audio signal portion, and such that the sample value of said sample of the two or more samples of the second audio signal portion is different from the sample value of said one of the samples of the decoded audio signal portion, when said computer program is run by a computer.

According to another embodiment, a system for improving a transition from a concealed audio signal portion of an audio signal to a succeeding audio signal portion of the audio signal may have: a switching module, an inventive apparatus being an apparatus for implementing energy damping, and an apparatus wherein the processor is configured to determine a second prototype signal portion, being the second sub-portion of the second audio signal portion, such that the second sub-portion includes fewer samples than the second audio signal portion, and wherein the processor is configured to determine one or more intermediate prototype signal portions by determining each of the one or more intermediate prototype signal portions by combining a first prototype signal portion, being the first sub-portion, and the second prototype signal portion, wherein the processor is configured to generate the decoded audio signal portion using the first prototype signal portion and using the one or more intermediate prototype signal portions and using the second prototype signal portion, said apparatus being an apparatus for pitch adapt overlap, wherein the switching module is configured to choose, depending on the concealed audio signal portion and depending on the succeeding audio signal portion, one of the apparatus for implementing energy damping and of the apparatus for implementing pitch adapt overlap for generating the decoded audio signal portion.

According to another embodiment, a system for improving a transition from a concealed audio signal portion of an audio signal to a succeeding audio signal portion of the audio signal may have: a switching module, an inventive apparatus being an apparatus for implementing energy damping, and an apparatus wherein the processor is configured to generate a first extended signal portion depending on the first sub-portion, so that the first extended signal portion is different from the first audio signal portion, and so that the first extended signal portion has more samples that the first sub-portion, wherein the processor is configured to generate the decoded audio signal portion using the first extended signal portion and using the second audio signal portion, said apparatus being an apparatus for implementing excitation overlap, wherein the switching module is configured to choose, depending on the concealed audio signal portion and depending on the succeeding audio signal portion, one of the apparatus for implementing energy damping and of the apparatus for implementing excitation overlap for generating the decoded audio signal portion.

According to another embodiment, a system for improving a transition from a concealed audio signal portion of an audio signal to a succeeding audio signal portion of the audio signal may have: a switching module, an inventive apparatus being an apparatus for implementing pitch adapt overlap, and an apparatus wherein the processor is configured to generate a first extended signal portion depending on the first sub-portion, so that the first extended signal portion is different from the first audio signal portion, and so that the first extended signal portion has more samples that the first sub-portion, wherein the processor is configured to generate the decoded audio signal portion using the first extended signal portion and using the second audio signal portion, said apparatus being an apparatus for implementing excitation overlap, wherein the switching module is configured to choose, depending on the concealed audio signal portion and depending on the succeeding audio signal portion, one of the apparatus for implementing pitch adapt overlap and of the apparatus for implementing excitation overlap for generating the decoded audio signal portion.

According to another embodiment, a system for improving a transition from a concealed audio signal portion of an audio signal to a succeeding audio signal portion of the audio signal may have: a switching module, an apparatus wherein the processor is configured to determine a second prototype signal portion, being the second sub-portion of the second audio signal portion, such that the second sub-portion includes fewer samples than the second audio signal portion, and wherein the processor is configured to determine one or more intermediate prototype signal portions by determining each of the one or more intermediate prototype signal portions by combining a first prototype signal portion, being the first sub-portion, and the second prototype signal portion, wherein the processor is configured to generate the decoded audio signal portion using the first prototype signal portion and using the one or more intermediate prototype signal portions and using the second prototype signal portion, said apparatus being an apparatus for implementing pitch adapt overlap, an apparatus wherein the processor is configured to generate a first extended signal portion depending on the first sub-portion, so that the first extended signal portion is different from the first audio signal portion, and so that the first extended signal portion has more samples that the first sub-portion, wherein the processor is configured to generate the decoded audio signal portion using the first extended signal portion and using the second audio signal portion, said apparatus being an apparatus for implementing excitation overlap, and an inventive apparatus being an apparatus for implementing energy damping, wherein the switching module is configured to choose, depending on the concealed audio signal portion and depending on the succeeding audio signal portion, one of the apparatus for implementing pitch adapt overlap and of the apparatus for implementing excitation overlap and of the apparatus for implementing energy damping for generating the decoded audio signal portion.

An apparatus for improving a transition from a concealed audio signal portion of an audio signal to a succeeding audio signal portion of the audio signal is provided.

The apparatus comprises a processor being configured to generate a decoded audio signal portion of the audio signal depending on a first audio signal portion and depending on a second audio signal portion, wherein the first audio signal portion depends on the concealed audio signal portion, and wherein the second audio signal portion depends on the succeeding audio signal portion.

Moreover, the apparatus comprises an output interface for outputting the decoded audio signal portion.

Each of the first audio signal portion and of the second audio signal portion and of the decoded audio signal portion comprises a plurality of samples, wherein each of the plurality of samples of the first audio signal portion and of the second audio signal portion and of the decoded audio signal portion is defined by a sample position of a plurality of sample positions and by a sample value, wherein the plurality of sample positions is ordered such that for each pair of a first sample position of the plurality of sample positions and a second sample position of the plurality of sample positions, being different from the first sample position, the first sample position is either a successor or a predecessor of the second sample position.

The processor is configured to determine a first sub-portion of the first audio signal portion, such that the first sub-portion comprises fewer samples than the first audio signal portion.

The processor is configured to generate the decoded audio signal portion using the first sub-portion of the first audio signal portion and using the second audio signal portion or a second sub-portion of the second audio signal portion, such that for each sample of two or more samples of the second audio signal portion, the sample position of said sample of the two or more samples of the second audio signal portion is equal to the sample position of one of the samples of the decoded audio signal portion, and such that the sample value of said sample of the two or more samples of the second audio signal portion is different from the sample value of said one of the samples of the decoded audio signal portion.

Moreover, a method for improving a transition from a concealed audio signal portion of an audio signal to a succeeding audio signal portion of the audio signal. The method comprises:

Generating a decoded audio signal portion of the audio signal depending on a first audio signal portion and depending on a second audio signal portion, wherein the first audio signal portion depends on the concealed audio signal portion, and wherein the second audio signal portion depends on the succeeding audio signal portion. And:

Outputting the decoded audio signal portion.

Each of the first audio signal portion and of the second audio signal portion and of the decoded audio signal portion comprises a plurality of samples, wherein each of the plurality of samples of the first audio signal portion and of the second audio signal portion and of the decoded audio signal portion is defined by a sample position of a plurality of sample positions and by a sample value, wherein the plurality of sample positions is ordered such that for each pair of a first sample position of the plurality of sample positions and a second sample position of the plurality of sample positions, being different from the first sample position, the first sample position is either a successor or a predecessor of the second sample position, Generating the decoded audio signal comprises determining a first sub-portion of the first audio signal portion, such that the first sub-portion comprises fewer samples than the first audio signal portion.

Moreover, generating the decoded audio signal portion is conducted using the first sub-portion of the first audio signal portion and using the second audio signal portion or a second sub-portion of the second audio signal portion, such that for each sample of two or more samples of the second audio signal portion, the sample position of said sample of the two or more samples of the second audio signal portion is equal to the sample position of one of the samples of the decoded audio signal portion, and such that the sample value of said sample of the two or more samples of the second audio signal portion is different from the sample value of said one of the samples of the decoded audio signal portion.

Furthermore, a computer program is provided that is configured to implement the above-described method when being executed on a computer or signal processor.

Some embodiments provide a recovery filter, a tool to smooth and repair the transition from a lost frame to a first good frame in a (e.g., block-based) audio codec. According to embodiments, the recovery filter can be used to fix the pitch change during the concealed frame in the first good frame of a speech signal, but also to smooth the transition of a noisy signal.

Inter alia, some embodiments are based on the finding that the length for signal modification is limited, beginning from the last sample played out in the concealed frame to the last sample of the first good frame. The length could be increased above the last sample in the first good frame, but then this would risk an error propagation which would be difficult to handle in future frames. Thus, a fast recovery is needed. In order to repair the speech characteristic in the case of a mismatch between the lost and recovered frame, the pitch of the signal in the recovery frame should be changed slowly from the pitch in the concealed frame to the pitch in the recovery frame while the restriction of the signal modification length have to be kept. With the TD-PSOLA algorithm, this would only be possible, if the pitch is changing by a multiple of an integer value. As this is a very rare case, TD-PSOLA cannot be applied in such situations.

BRIEF DESCRIPTION OF THE DRAWINGS

Embodiments of the present invention will be detailed subsequently referring to the appended drawings, in which.

DETAILED DESCRIPTION OF THE INVENTION

Figure 1A:
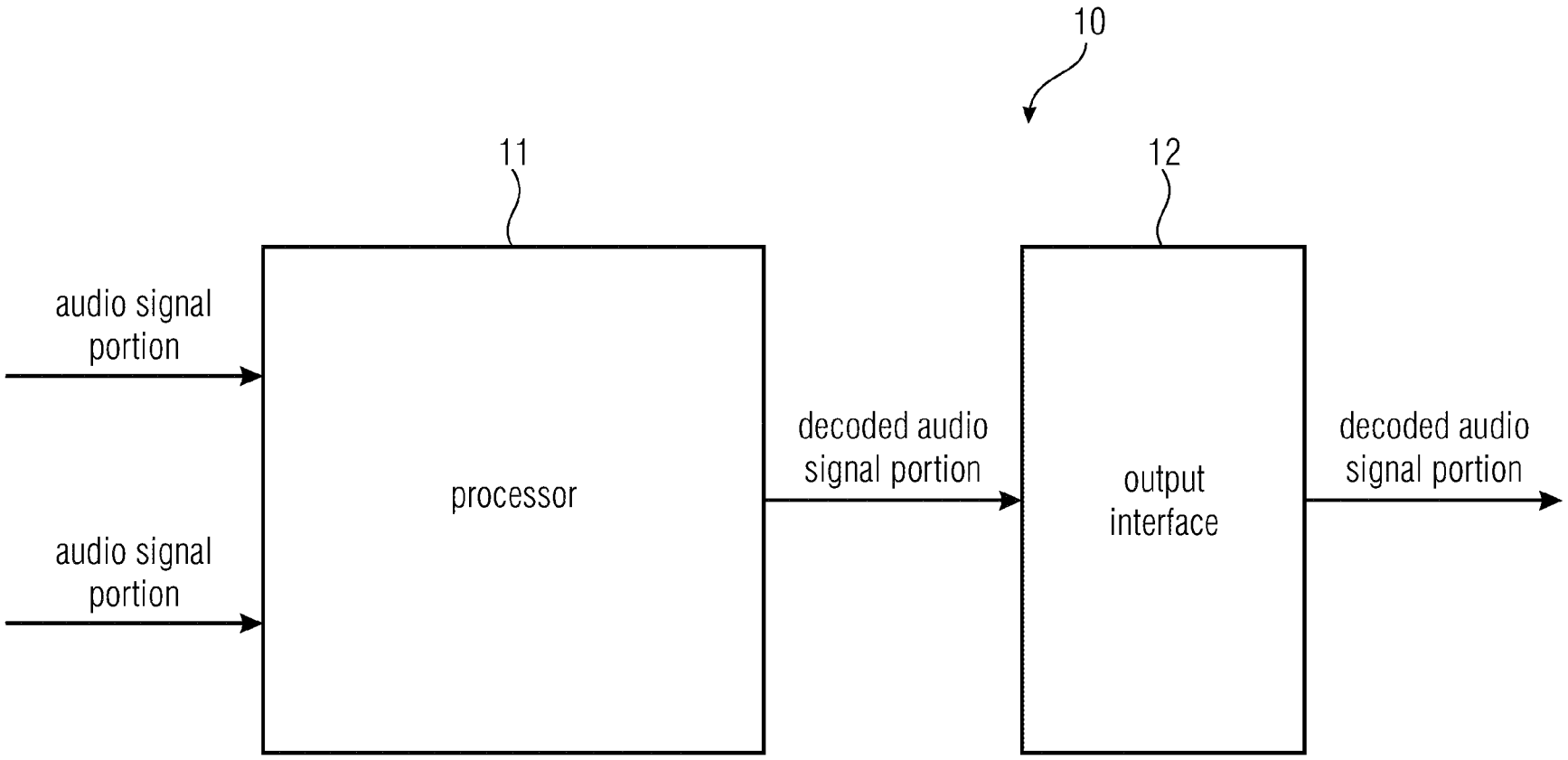
FIG. 1*a* illustrates an apparatus for improving a transition from a concealed audio signal portion of an audio signal to a succeeding audio signal portion of the audio signal according to an embodiment.

FIG. 1*a* illustrates an apparatus 10 for improving a transition from a concealed audio signal portion of an audio signal to a succeeding audio signal portion of the audio signal according to an embodiment.

The apparatus 10 comprises a processor 11 being configured to generate a decoded audio signal portion of the audio signal depending on a first audio signal portion and depending on a second audio signal portion, wherein the first audio signal portion depends on the concealed audio signal portion, and wherein the second audio signal portion depends on the succeeding audio signal portion.

In some embodiments, the first audio signal portion may, e.g., be derived from the concealed audio signal portion, but may, e.g., be different from the concealed audio signal portion, and/or the second audio signal portion may, e.g., be derived from the succeeding audio signal portion, but may, e.g., be different from the succeeding audio signal portion.

In other embodiments, the first audio signal portion may, e.g., be (equal to) the concealed audio signal portion, and the second audio signal portion may, e.g., be the succeeding audio signal portion.

Moreover, the apparatus 10 comprises an output interface 12 for outputting the decoded audio signal portion.

Each of the first audio signal portion and of the second audio signal portion and of the decoded audio signal portion comprises a plurality of samples, wherein each of the plurality of samples of the first audio signal portion and of the second audio signal portion and of the decoded audio signal portion is defined by a sample position of a plurality of sample positions and by a sample value, wherein the plurality of sample positions is ordered such that for each pair of a first sample position of the plurality of sample positions and a second sample position of the plurality of sample positions, being different from the first sample position, the first sample position is either a successor or a predecessor of the second sample position.

For example, a sample is defined by a sample position and a sample value. For example, the sample position may define an x-axis value (abscissa axis value) of the sample and the sample value may define a y-axis value (ordinate axis value) of the same in a two-dimensional coordinate system. Thus, considering a particular sample, all samples located left of the particular sample within the two-dimensional coordinate system are predecessors of the particular sample (because their sample position is smaller than the sample position of the particular sample). All samples located right of the particular sample within the two-dimensional coordinate system are successors of the particular sample (because their sample position is greater than the sample position of the particular sample).

The processor 11 is configured to determine a first sub-portion of the first audio signal portion, such that the first sub-portion comprises fewer samples than the first audio signal portion.

The processor 11 is configured to generate the decoded audio signal portion using the first sub-portion of the first audio signal portion and using the second audio signal portion or a second sub-portion of the second audio signal portion, such that for each sample of two or more samples of the second audio signal portion, the sample position of said sample of the two or more samples of the second audio signal portion is equal to the sample position of one of the samples of the decoded audio signal portion, and such that the sample value of said sample of the two or more samples of the second audio signal portion is different from the sample value of said one of the samples of the decoded audio signal portion.

Thus, in some embodiments the processor 11 is configured to generate the decoded audio signal portion using the first sub-portion and using the second audio signal portion.

In other embodiments, the processor 11 is to generate the decoded audio signal portion using the first sub-portion and using a second sub-portion of the second audio signal portion. The second sub-portion may comprise fewer samples than the second audio signal portion.

Embodiments are based on the finding that it is beneficial to improve a transition from a concealed audio signal portion of an audio signal to a succeeding audio signal portion of the audio signal by modifying the samples of the succeeding audio signal portion and not only by adjusting the samples of a concealed audio signal. By also modifying samples of a correctly received frame, a transition from a concealed audio signal portion (e.g., of a concealed audio signal frame) to a succeeding audio signal portion (e.g., of a succeeding audio signal frame) can be improved.

So, the decoded audio signal portion is generated using the first and the second audio signal portion, but the decoded audio signal portion (at least two or more) comprises samples that are assigned to sample positions as samples of the second audio signal portion (that depends on the succeeding audio signal portion) whose sample values differ.

That means that for these samples, the sample values of the corresponding samples are not taken as they are, but are modified instead, to obtain the corresponding samples of the decoded audio signal portion.

Regarding the first audio signal portion and the second audio signal portion, the processor 11 may, for example, receive the first audio signal portion and the second audio signal portion.

Or, in another embodiment, for example, the processor 11 may, for example, receive the concealed audio signal portion and may determine the first audio signal portion from the concealed audio signal portion, and the processor 11 may, for example, receive the succeeding audio signal portion and may determine the second audio signal portion from the succeeding audio signal portion.

Or, in a further embodiment, for example, the processor 11 may, for example, receive audio signal frames; the processor 11 may, for example, determine that a first frame got lost or that the first frame is corrupted. The processor 11 may then conduct concealment and may, e.g., generate the concealed audio signal portion according to state-of-the-art concepts. Moreover, the processor 11 may, e.g., receive a second audio signal frame and may, obtain the succeeding audio signal portion from the second audio signal frame. FIG. 1*e* illustrates such an embodiment.

In some embodiments, the first audio signal portion may, for example, be a residual signal portion of a first residual signal being a residual signal with respect to the concealed audio signal portion. The second audio signal portion may, for example, in some embodiments, be a residual signal portion of a second residual signal being a residual signal with respect to the succeeding audio signal portion.

In FIG. 1*e*, the apparatus 10 further comprises a concealment unit 8 being configured to conduct concealment for a current frame that is erroneous or that got lost to obtain the concealed audio signal portion.

According to embodiments of FIG. 1*e*, the apparatus further comprises a concealment unit 8. The concealment unit 8 may, e.g., be configured to conduct concealment according to the state-of-the art, if a frame gets lost or is corrupted. The concealment unit 8 then delivers the concealed audio signal portion to the processor 11. In such an embodiment, the concealed audio signal portion may, e.g., be a concealed audio signal portion for an erroneous or lost frame for which concealment has conducted. The succeeding audio signal portion may, e.g. be a succeeding audio signal portion of a (succeeding) audio signal frame, for which no concealment has been conducted. The succeeding audio signal frame, may, e.g., succeed the erroneous or lost frame in time.

Figure 1B:
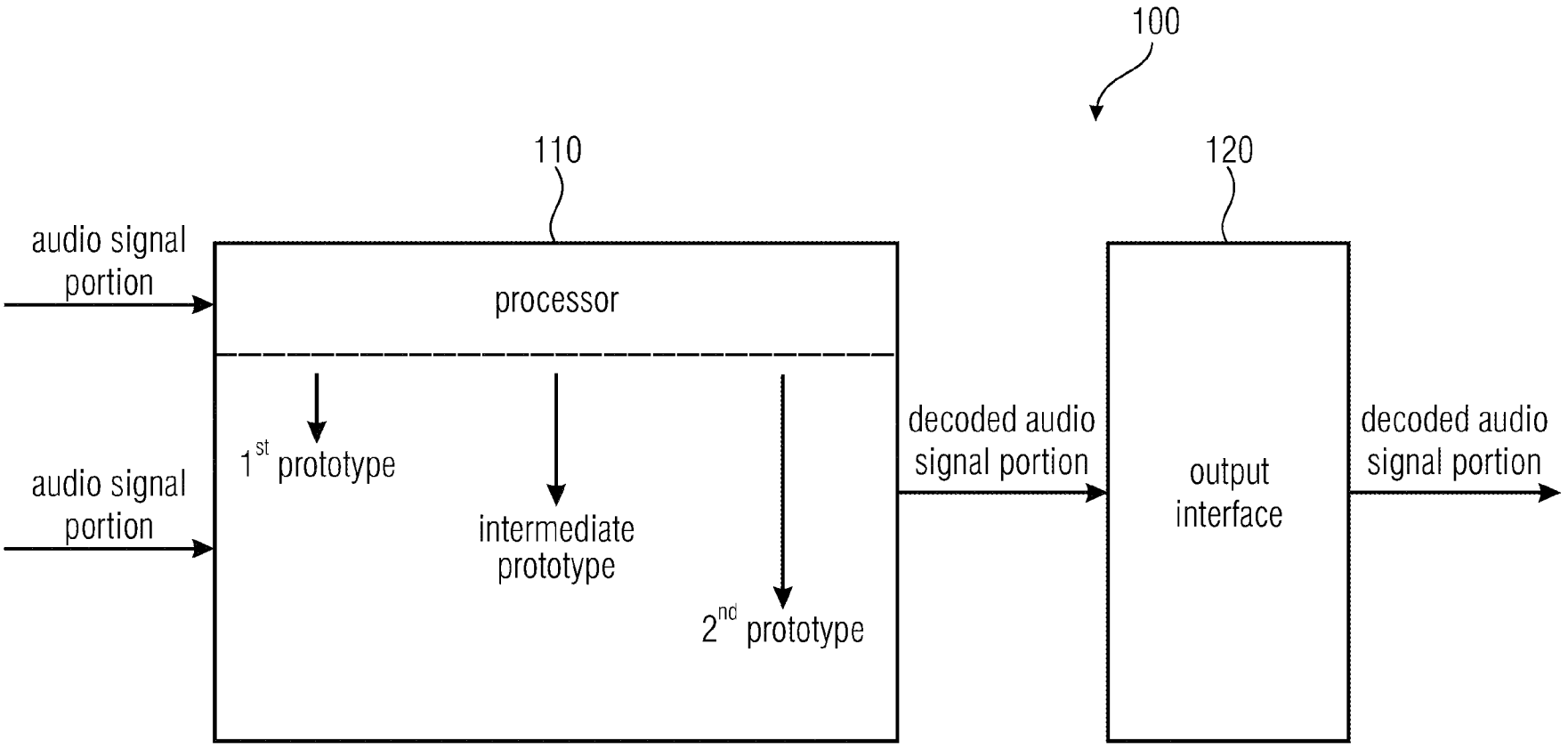
FIG. 1*b* illustrates an apparatus for improving a transition from a concealed audio signal portion of an audio signal to a succeeding audio signal portion of the audio signal according to another embodiment implementing a pitch adapt overlap concept.
Figure 1C:
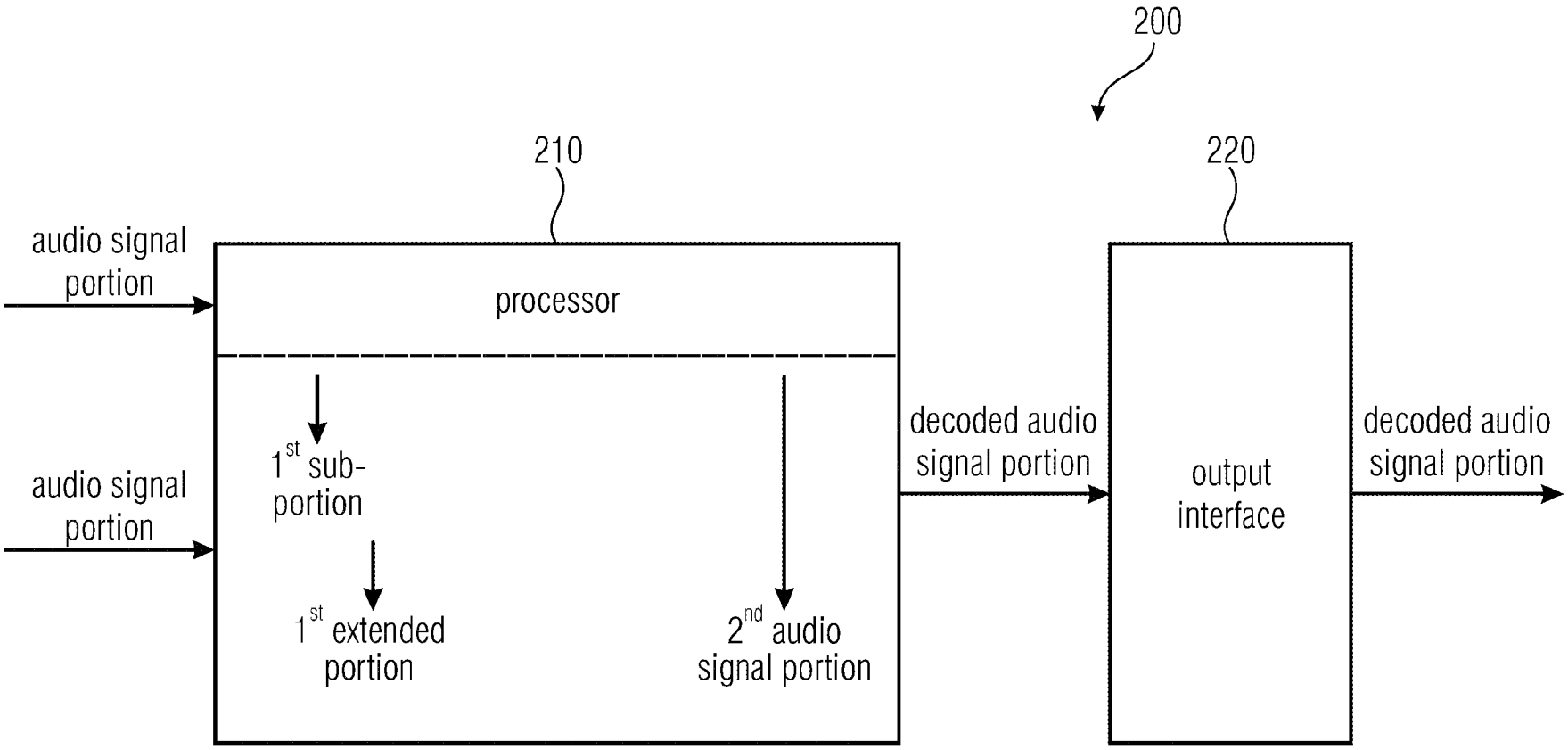
FIG. 1*c* illustrates an apparatus for improving a transition from a concealed audio signal portion of an audio signal to a succeeding audio signal portion of the audio signal according to another embodiment implementing an excitation overlap concept.
Figure 1D:
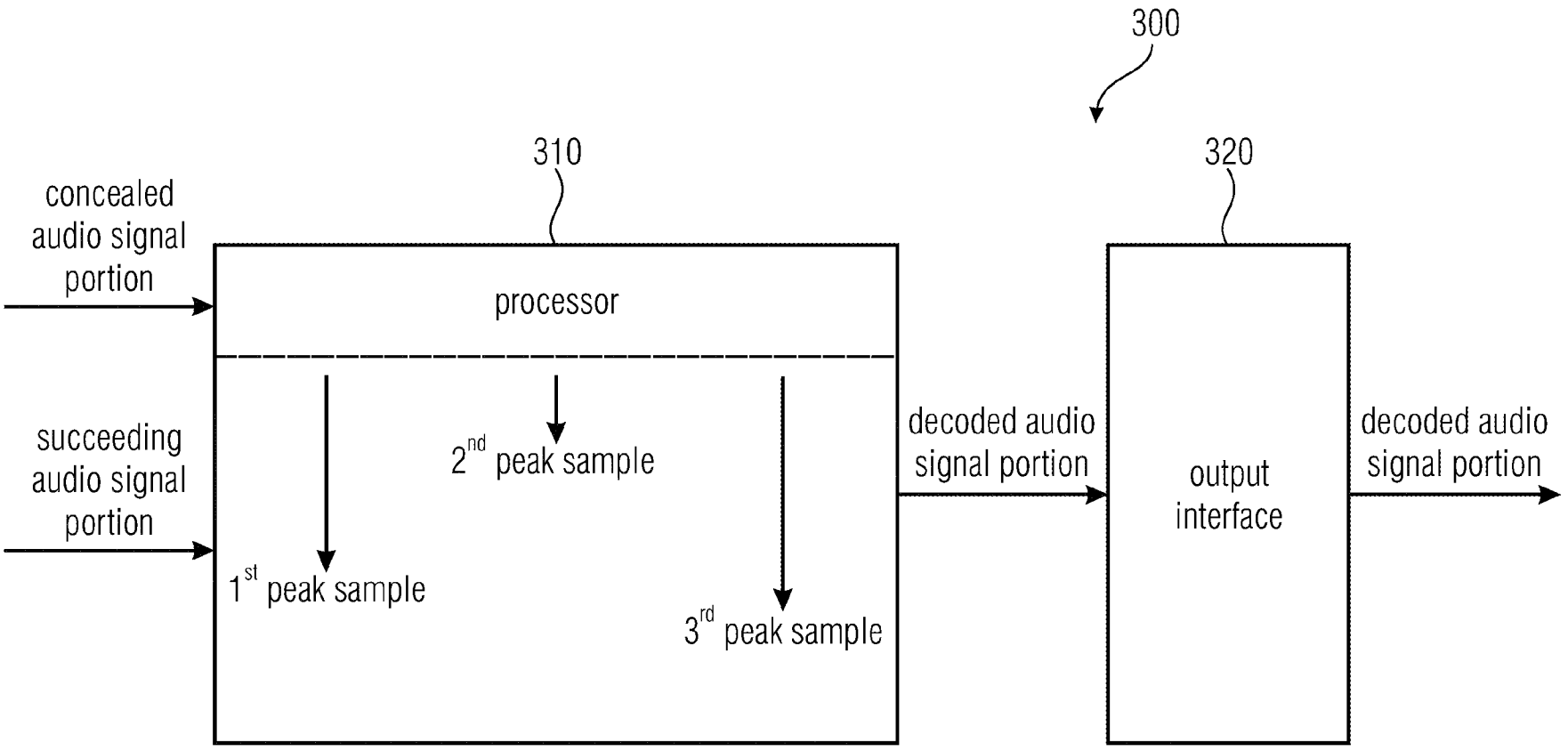
FIG. 1*d* illustrates an apparatus for improving a transition from a concealed audio signal portion of an audio signal to a succeeding audio signal portion of the audio signal according to a further embodiment implementing energy damping.
Figure 1E:
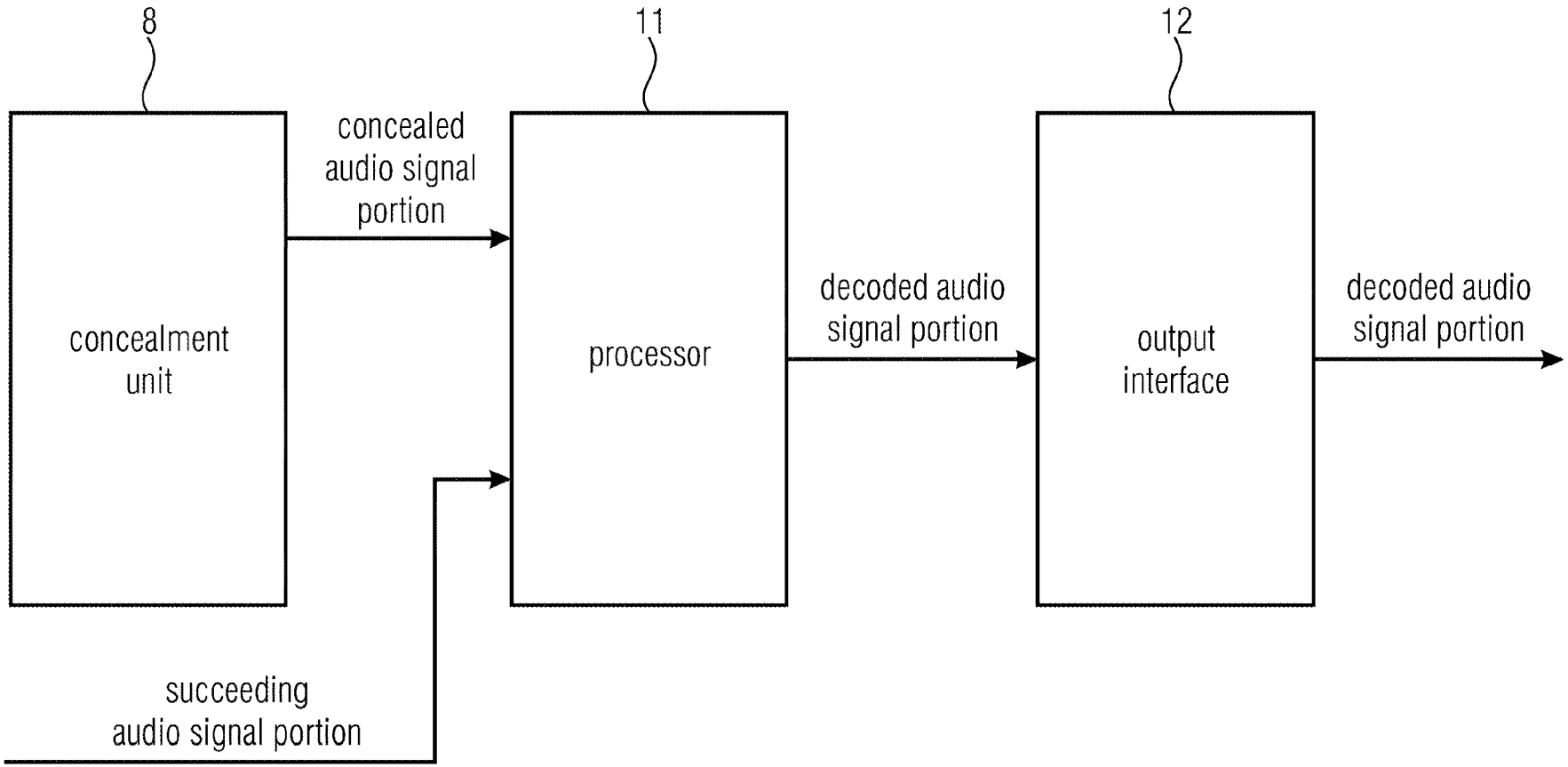
FIG. 1*e* illustrates an apparatus according to a further embodiment, wherein the apparatus further comprises a concealment unit.
Figure 1F:
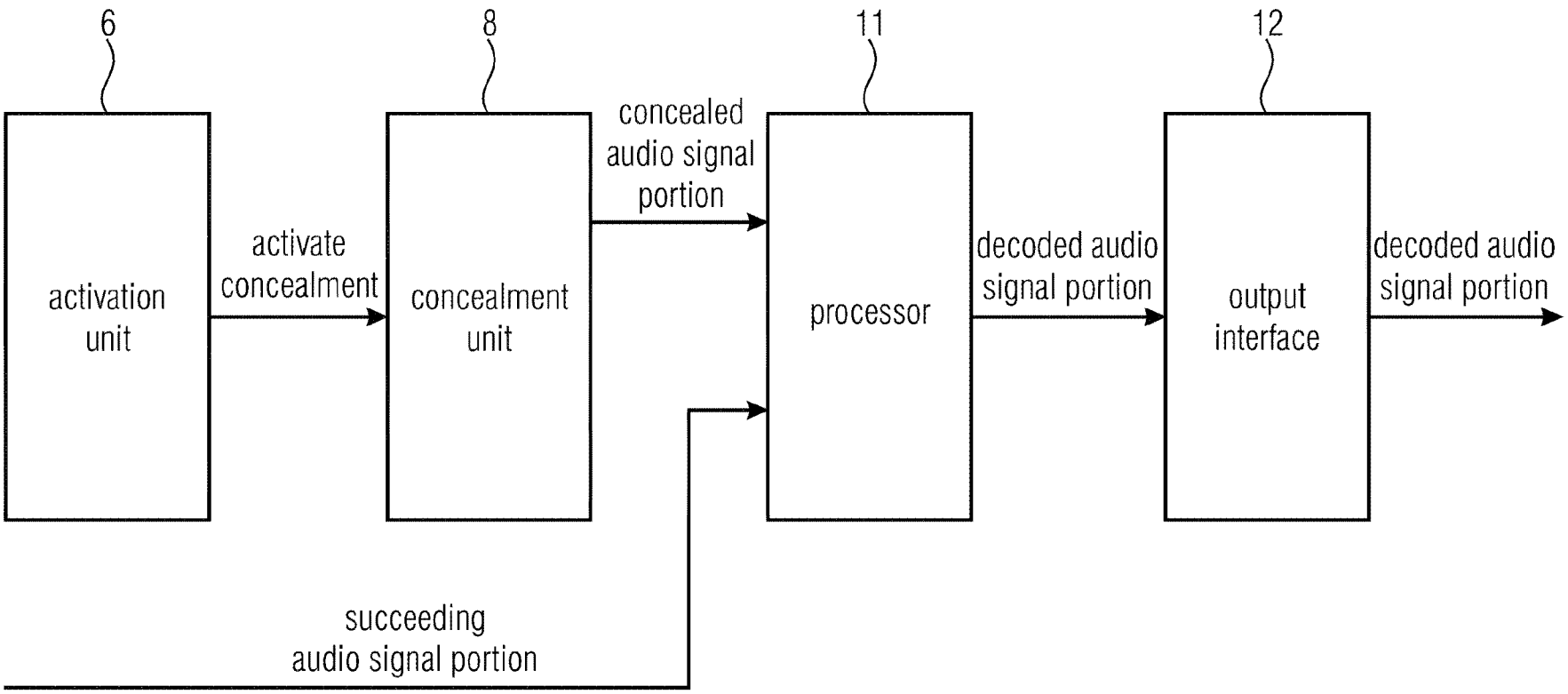
FIG. 1*f* illustrates an apparatus according to another embodiment, wherein the apparatus further comprises an activation unit for activating the concealment unit.

FIG. 1*f* illustrates embodiments, wherein the apparatus 10 further comprises an activation unit 6 that may, e.g., be configured to detect whether the current frame got lost or is erroneous. For example, the activation unit 6 may, e.g., conclude that a current frame got lost, if it does not arrive within a predefined time limit after the last received frame. Or, for example, the activation unit may, e.g., conclude that the current frame got lost if a further frame, e.g., a succeeding frame, arrives that has a greater frame number than the current frame. An activation unit 6 may, e.g., conclude that a frame is erroneous, if, e.g., a received checksum or received check bits are not equal to a calculated checksum or to calculated check bits, calculated by the activation unit.

The activation unit 6 of FIG. 1*f* may, e.g., be configured to activate the concealment unit 8 to conduct the concealment for the current frame, if the current frame got lost or is erroneous.

Figure 1G:
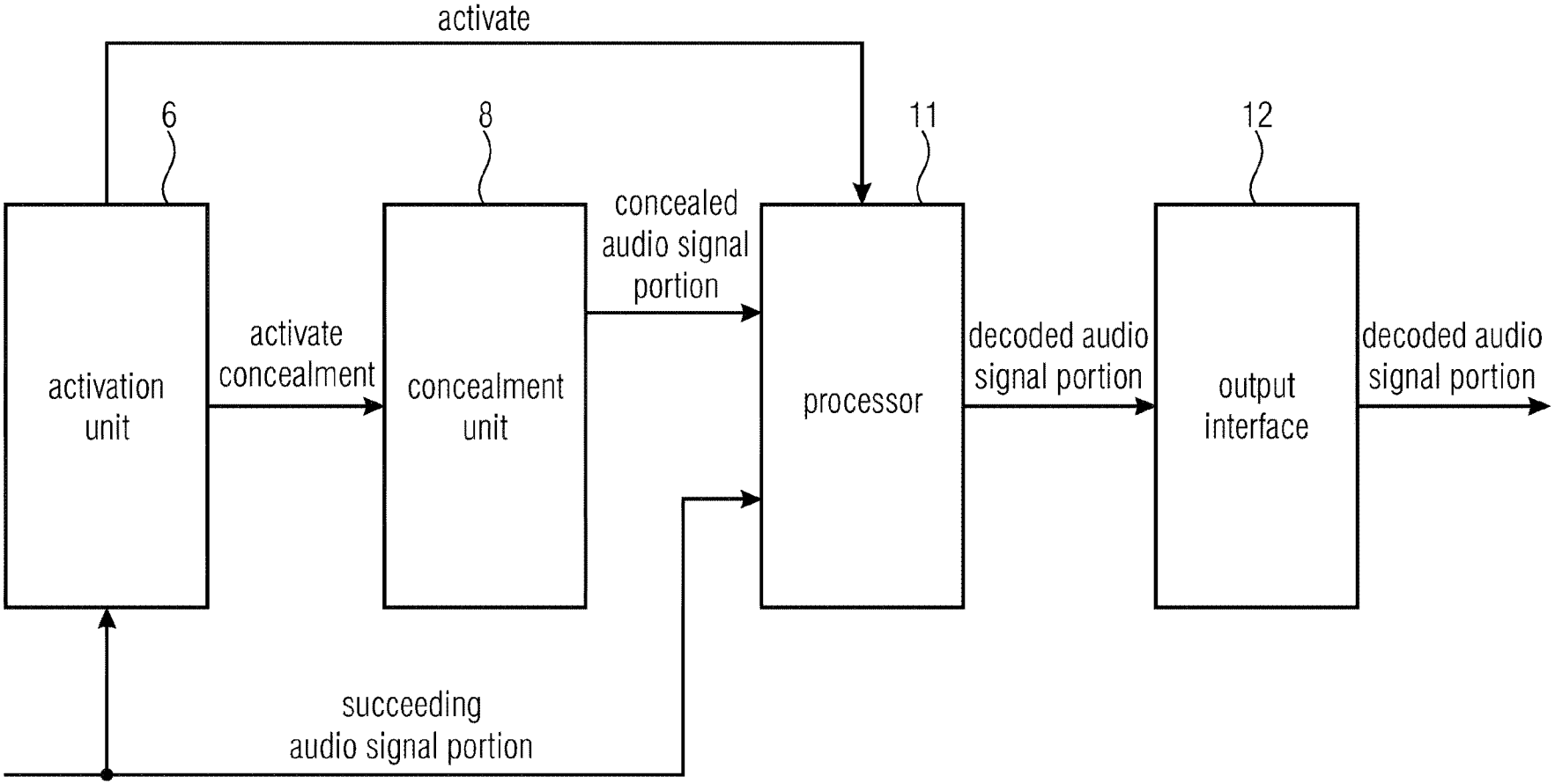
FIG. 1*g* illustrates an apparatus according to a further embodiment, wherein the activation unit is further configured to activate the processor.

FIG. 1*g* illustrates embodiments, wherein the activation unit 6 may, e.g., be configured to detect whether a succeeding frame arrives that is not erroneous, if the current frame got lost or was erroneous. In the embodiment of FIG. 1*g*, the activation unit 6 may, e.g., be configured to activate the processor (8) to generate the decoded audio signal portion, if the current frame got lost or is erroneous and if the succeeding frame arrives that is not erroneous.

FIG. 1*b* illustrates an apparatus 100 for improving a transition from a concealed audio signal portion of an audio signal to a succeeding audio signal portion of the audio signal according to another embodiment. The apparatus of FIG. 1*b* implements a pitch adapt overlap concept.

The apparatus 100 of FIG. 1*b* is a particular embodiment of the apparatus 10 of FIG. 1*a*. The processor 110 of FIG. 1*b* is a particular embodiment of the processor 11 of FIG. 1*a*.

The output interface 120 of FIG. 1*b* is a particular embodiment of the output interface 12 of FIG. 1*a*.

In the embodiment of FIG. 1*b*, the processor 110 may, e.g., be configured to determine a second prototype signal portion, being the second sub-portion of the second audio signal portion, such that the second sub-portion comprises fewer samples than the second audio signal portion.

The processor 110 may, e.g., be configured to determine one or more intermediate prototype signal portions by determining each of the one or more intermediate prototype signal portions by combining a first prototype signal portion, being the first sub-portion, and the second prototype signal portion.

In FIG. 1*b*, the processor 110 may, e.g., be configured to generate the decoded audio signal portion using the first prototype signal portion and using the one or more intermediate prototype signal portions and using the second prototype signal portion.

According to an embodiment, the processor 110 may, e.g., be configured to generate the decoded audio signal portion by combining the first prototype signal portion and the one or more intermediate prototype signal portions and the second prototype signal portion.

In an embodiment, the processor 110 is configured to determine a plurality of three or more marker sample positions determine a plurality of three or more marker sample positions, wherein each of the three or more marker sample positions is a sample position of at least one of the first audio signal portion and the second audio signal portion.

Moreover, the processor 110 is configured to choose a sample position of a sample of the second audio signal portion which is a successor for any other sample position of any other sample of the second audio signal portion as an end sample position of the three or more marker sample positions. Furthermore, the processor 110 is configured to determine a start sample position of the three or more marker sample positions by selecting a sample position from the first audio signal portion depending on a correlation between a first sub-portion of the first audio signal portion and a second sub-portion of the second audio signal portion. Moreover, the processor 110 is configured to determine one or more intermediate sample positions of the three or more marker sample positions depending on the start sample position of the three or more marker sample positions and depending on the end sample position of the three or more marker sample positions. Furthermore, the processor 110 is configured to determine the one or more intermediate prototype signal portions by determining for each of said one or more intermediate sample positions an intermediate prototype signal portion of the one or more intermediate prototype signal portions by combining the first prototype signal portion and the second prototype signal portion depending on said intermediate sample position.

According to an embodiment, the processor 110 is configured to determine the one or more intermediate prototype signal portions by determining for each of said one or more intermediate sample positions an intermediate prototype signal portion of the one or more intermediate prototype signal portions by combining the first prototype signal portion and the second prototype signal portion according to $$sig_i = (1-\alpha)\cdot sig_{first} + \alpha \cdot sig_{last}$$

where $$\alpha = \frac{i}{nrOfMarkers}$$

wherein i is an integer, with i≥1, wherein nrOfMarkers is the number of the three or more marker sample positions minus 1, wherein $sig_i$ is an i-th intermediate prototype signal portion of the one or more intermediate prototype signal portion, wherein $sig_{first}$ is the first prototype signal portion, wherein $sig_{last}$ is the second prototype signal portion.

In an embodiment, the processor 110 is configured to determine the one or more intermediate sample positions of the three or more marker sample positions depending on $$mark_i = mark_{i-1} + T_c + \text{floor}\left(\frac{\delta \cdot i}{div} + 0.5\right),$$

$$i = 1 \ldots nrOFMarkers - 1$$

or depending on $$mark_i = mark_{i+1} - T_c - \text{floor}\left(\frac{\delta \cdot j}{div} + 0.5\right),$$

$$i = nrOfMarkers - 1 \ldots 1,\ j = 1 \ldots nrOfMarkers - 1$$

$$\text{wherein } nrOfMarkers = \text{floor}\left(\frac{x_1 - x_0}{T_c} + 0.5\right),$$

$$\text{wherein } \delta = x_1 - (x_0 + nrOfMarkers \cdot T_c),$$

$$\text{wherein } div = \frac{nrOfMarkers(nrOfMarkers + 1)}{2},$$

wherein i is an integer, with i≥1, wherein nrOfMarkers is the number of the three or more marker sample positions minus 1, wherein $mark_i$ is the i-th intermediate sample position of the three or more marker sample positions, wherein $mark_{i-1}$ is the i−1-th intermediate sample position of the three or more marker sample positions, wherein $mark_{i+1}$ is the i+1-th intermediate sample position of the three or more marker sample positions, wherein $x_0$ is the start sample position of the three or more marker sample positions, wherein $x_1$ is the end sample position of the three or more marker sample positions, and wherein $T_c$ indicates a pitch lag.

According to an embodiment, the processor 110 is configured to determine the first audio signal portion depending on the concealed audio signal portion and depending on a plurality of third filter coefficients, wherein the plurality of third filter coefficients depends on the concealed audio signal portion and on the succeeding audio signal portion, and wherein the processor 110 is configured to determine the second audio signal portion depending on the succeeding audio signal portion and on the plurality of third filter coefficients.

In an embodiment, the processor 110 may, e.g., comprise a filter, wherein the processor 110 is configured to apply the filter with the third filter coefficients on the concealed audio signal portion to obtain the first audio signal portion, and wherein the processor 110 is configured to apply the filter with the third filter coefficients on the succeeding audio signal portion to obtain the second audio signal portion.

According to an embodiment, the processor 110 is configured to determine a plurality of first filter coefficients depending on the concealed audio signal portion, wherein the processor 110 is configured to determine a plurality of second filter coefficients depending on the succeeding audio signal portion, wherein the processor 110 is configured to determine each of the third filter coefficients depending on a combination of one or more of the first filter coefficients and one or more of the second filter coefficients.

In an embodiment, the filter coefficients of the plurality of first filter coefficients and of the plurality of second filter coefficients and of the plurality of third filter coefficients are Linear Predictive Coding parameters of a Linear Predictive Filter.

According to an embodiment, the processor 110 is configured to determine each filter coefficient of the third filter coefficients according to the formula:

$$A = 0.5 \cdot A_{conc} + 0.5 \cdot A_{good}$$

wherein A indicates a filter coefficient value of said filter coefficient, wherein $A_{conc}$ indicates a coefficient value of a filter coefficient of the plurality of first filter coefficients, and wherein $A_{good}$ indicates a coefficient value of a filter coefficient of the plurality of second filter coefficients.

In an embodiment, the processor 110 is configured to apply a cosine window defined by $$w(x) = \begin{cases} 0.54 - 0.46 \cdot \cos\left(\frac{2\pi x}{2x_1 - 1}\right), & x = 0 \ldots x_1 - 1 \\ \cos\left(\frac{2\pi(x - x_1)}{4x_2 - 1}\right), & x = x_1 \ldots x_1 + x_2 - 1 \end{cases}$$

on the concealed audio signal portion to obtain a concealed windowed signal portion, wherein the processor 110 is configured to apply said cosine window on the succeeding audio signal portion to obtain a succeeding windowed signal portion, wherein the processor 110 is configured to determine the plurality of first filter coefficients depending on the concealed windowed signal portion, wherein the processor 110 is configured to determine the plurality of second filter coefficients depending on the succeeding windowed signal portion, and wherein each of x and $x_1$ and $x_2$ is a sample position of the plurality of sample positions.

According to an embodiment, the processor 110 may, e.g., be configured to select as said first prototype signal portion, a sub-portion of a plurality of sub-portion candidates of the first audio signal portion depending on a plurality of correlations of each sub-portion of the plurality of sub-portion candidates of the first audio signal portion and of said second sub-portion of the second audio signal portion. The processor 110 may, e.g., be configured to select, as the start sample position of the three or more marker sample positions, a sample position of the plurality of samples of said first prototype signal portion which is a predecessor for any other sample position of any other sample of said first prototype signal portion.

In an embodiment, the processor 110 may, e.g., be configured to select as said first prototype signal portion, the sub-portion of said sub-portion candidates, the correlation of which with said second sub-portion has a highest correlation value among said plurality of correlations.

According to an embodiment, the processor 110 is configured to determine for each correlation of the plurality of correlations a correlation value according to the formula, $$\sum_{i=1}^{T_g} \frac{r(2L_{frame} - i)(L_{frame} - i - \Delta)}{\sqrt{r(2L_{frame} - i)^2 r(L_{frame} - i - \Delta)^2}},$$

wherein $L_{frame}$ indicates a number of samples of the second audio signal portion being equal to a number of samples of the first audio signal portion, wherein $r(2\,L_{frame} - i)$ indicates a sample value of a sample of the second audio signal portion at a sample position $2\,L_{frame} - i$, wherein $r(L_{frame} - i - \Delta)$ indicates a sample value of a sample of the first audio signal portion at a sample position $L_{frame} - i - \Delta$, wherein for each of the plurality of correlations of a sub-portion candidate of the plurality of sub-portion candidates and of said second sub-portion, Δ indicates a number and depends on said sub-portion candidate.

Pitch adapt overlap is used to compensate pitch differences that could appear between the pitch of the beginning of the first good decoded frame after a frame loss and the pitch at the end of the frame concealed with TD PLC. The signal is operating in the LPC domain, to smooth the constructed signal in the end of the algorithm with a LPC synthesis filter. In the LPC domain, the instant with the highest similarity is found by a cross correlation as explained below and the pitch of the signal is slowly evolved from the last pitch lag $T_c$ to the new one $T_g$ to avoid abrupt pitch changes.

In the following, pitch adapt overlap according to particular embodiments is described.

An apparatus or a method according to such embodiments, may, for example, be realized as follows:

Calculate 16 order LPC parameters $A_{conc}$ and $A_{good}$ on pre-emphased concealed signal $s(0{:}L_{frame}-1)$ and first good frame $s(L_{frame}{:}2L_{fame}-1)$ respectively with a Hamming-cosine window, for example, a Hamming cosine window of the following form:

$$w(x) = \begin{cases} 0.54 - 0.46 \cdot \cos\left(\frac{2\pi x}{2x_1 - 1}\right), & x = 0 \ldots x_1 - 1 \\ \cos\left(\frac{2\pi(x - x_1)}{4x_2 - 1}\right), & x = x_1 \ldots x_1 + x_2 - 1 \end{cases}$$

where $x_1$=200 and $x_2$=40 for a frame length of 480 samples.

Figure 2:
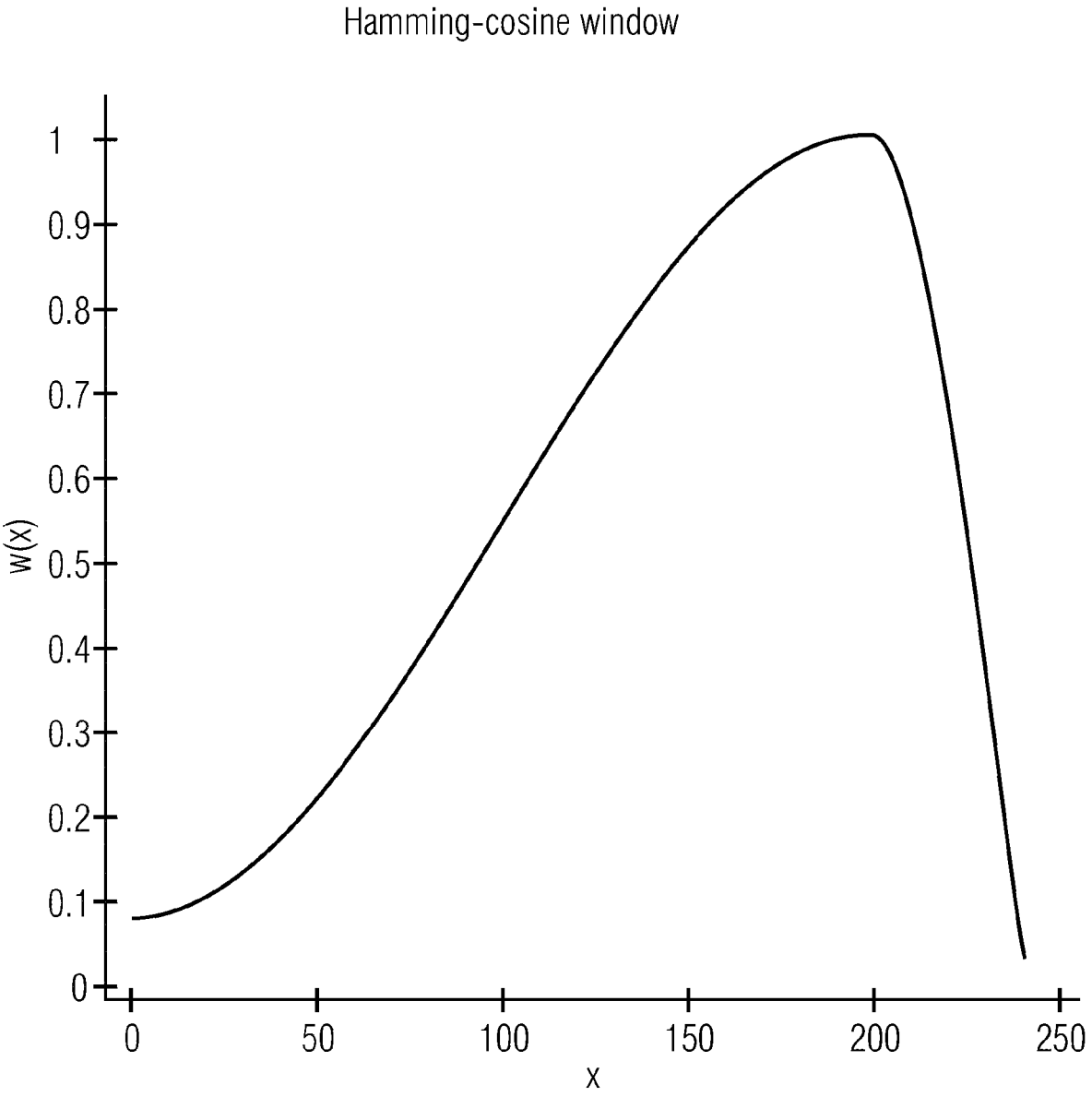
FIG. 2 illustrates a Hamming-cosine window according to an embodiment.

FIG. 2 illustrates such a Hamming-cosine window according to an embodiment. The shape of the window may, e.g., be designed in such a way that the last signal samples of the signal part have the highest influence in the analysis.

Do interpolation in LSP-domain to get $A=0.5.\ A_{conc} + 0.5 \cdot A_{good}$

Calculate LPC residual signals with A in concealed frame:

$$r(x) = \sum_{k=0}^{16} A(k) \cdot s(x - k),$$

$$x = L_{frame} - T_c \ldots L_{frame}$$

and first good frame:

$$r(x) = \sum_{k=0}^{16} A(k) \cdot s(x - k),$$

$$x = 2 \cdot L_{frame} - T_g \ldots 2 \cdot L_{frame}$$

Find the instant $x_0$ which represents the maximal similarity between the end of the concealed frame and the end of the good frame $x_1$ being $2L_{frame}-1$.

Figure 3:
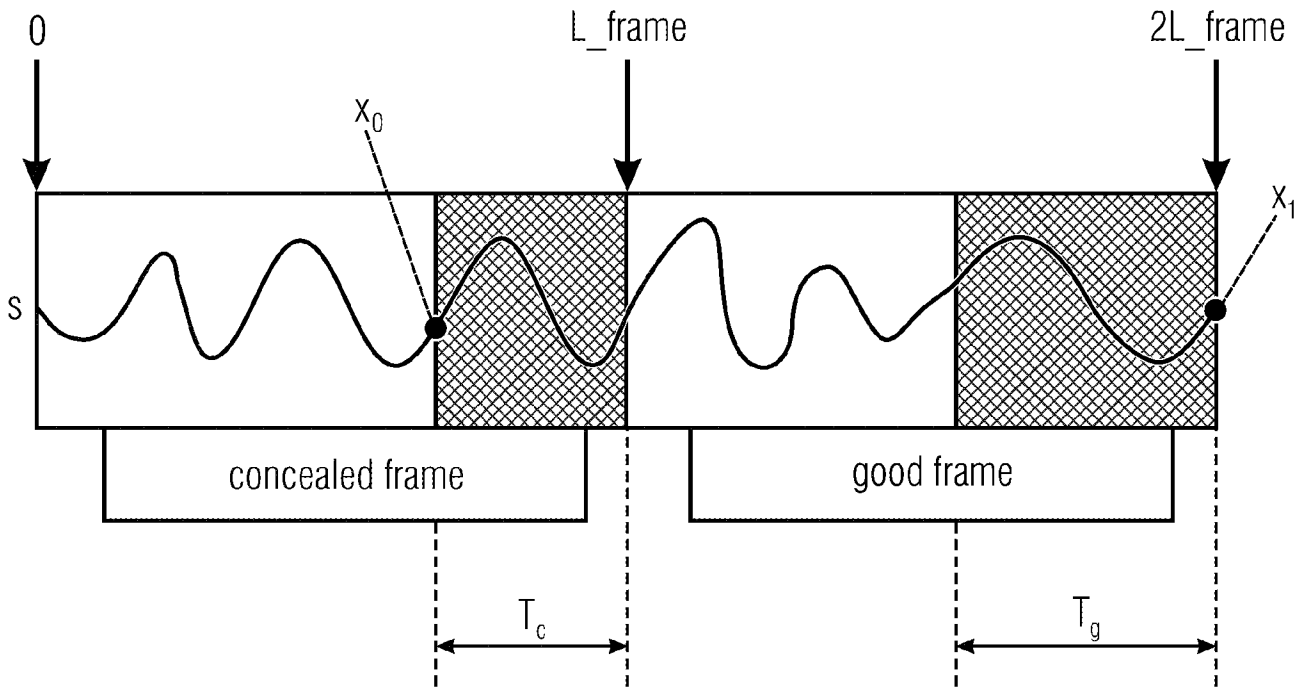
FIG. 3 illustrates a concealed frame and a good frame according to such an embodiment.

FIG. 3 illustrates a concealed frame and a good frame according to such an embodiment.

Getting $x_0$ is done by maximize the normalized cross-correlation:

$$\sum_{i=1}^{T_g} \frac{r(2L_{frame} - i) r(L_{frame} - i - \Delta)}{\sqrt{r(2L_{frame} - i)^2 r(L_{frame} - i - \Delta)^2}},$$

$$\Delta = 0 \ldots T_c$$

Usually the normalization is done at the end of the correlation: for example in pitch search, the normalization is done after the correlation when a pitch value is already found.

The normalization is done here during the correlation, to be robust against energy fluctuations between the signals. For complexity reasons, the normalization terms are calculated on an update scheme. Only for the initial value $$\mathrm{norm}_{\Delta}=\Sigma_{i=0}^{T_g} r(L_{frame}--i-\Delta)^2$$

with $\Delta=0$, the full dot products may, e.g., be calculated. For the next increment of $\Delta$, the term may, e.g., be updated as follows:

$$\mathrm{norm}_{\Delta}=\mathrm{norm}_{\Delta-1}+r(L_{frame}-T_g-\Delta)^2-r(L_{frame}-\Delta)^2, \Delta=1 \ldots T_c$$

To slowly evolve the pitch lag from the last one $T_c$ ($x_0$) to the new one $T_g$ ($x_1$), the instants mark in between have to be set, where $$mark_0 = x_0$$

$$mark_{nrOfMarkers} = x_1$$

$$nrOfMarkers = \mathrm{floor}\left(\frac{x_1 - x_0}{T_c} + 0.5\right)$$

If nrOfMarkers is lower than one or higher than 12, the algorithm switches to energy damping. Otherwise, if $\delta>0$ and $T_c<T_g$ or $\delta<0$ and $T_c>T_g$, where $$\delta = x_1 - (x_0 + nrOfMarkers \cdot T_c)$$

and $$div = \frac{nrOfMarkers(nrOfMarkers + 1)}{2},$$

the markers are calculated from left to right as follow:

$$mark_i = mark_{i-1} + T_c + \mathrm{floor}\left(\frac{\delta \cdot i}{div} + 0.5\right), i = 1 \ldots nrOfMarkers - 1$$

otherwise, the markers are built from right to left:

$$mark_i = mark_{i+1} - T_c - \mathrm{floor}\left(\frac{\delta \cdot j}{div} + 0.5\right), i = nrOfMarkers - 1 \ldots 1, j = 1 \ldots nrOfMarkers - 1$$

It should be noted that nrOfMarkers is the number of all markers minus 1. Or expressed in a different way, nrOfMarkers is the number of all marker sample positions minus 1, because $x_0=mark_0$ and $x_1=mark_{nrOfMarkers}$ are also markers/marker sample positions. For example, if nrOfMarkers=4, then there are 5 markers/5 marker sample positions, namely $mark_0$, $mark_1$, $mark_2$, $mark_3$ and $mark_4$, For the synthesized signal, cutting-out input segments are windowed and set around the instants mark. (the segments are shift in time to be centered on the instant mark). To slowly smooth from the concealed signal shape to the overlap-free good signal, the segments will be a linear combination of the two not overlapping parts: being the end of the concealed frame and the end of the good frame. Hereinafter referred to as prototypes $sig_{first}$ and $sig_{last}$.

The length len of the prototypes is twice the smallest marker distance minus 1, to prevent possible energy increases in the overlap add synthesis operation. If the distance between two markers is not between $T_c$ and $T_g$, this would lead to problems at the borders. (Thus, in a particular embodiment, an algorithm may, e.g., abort in these cases and may, e.g., switch to energy damping. Energy damping will be described below.)

Figure 4:
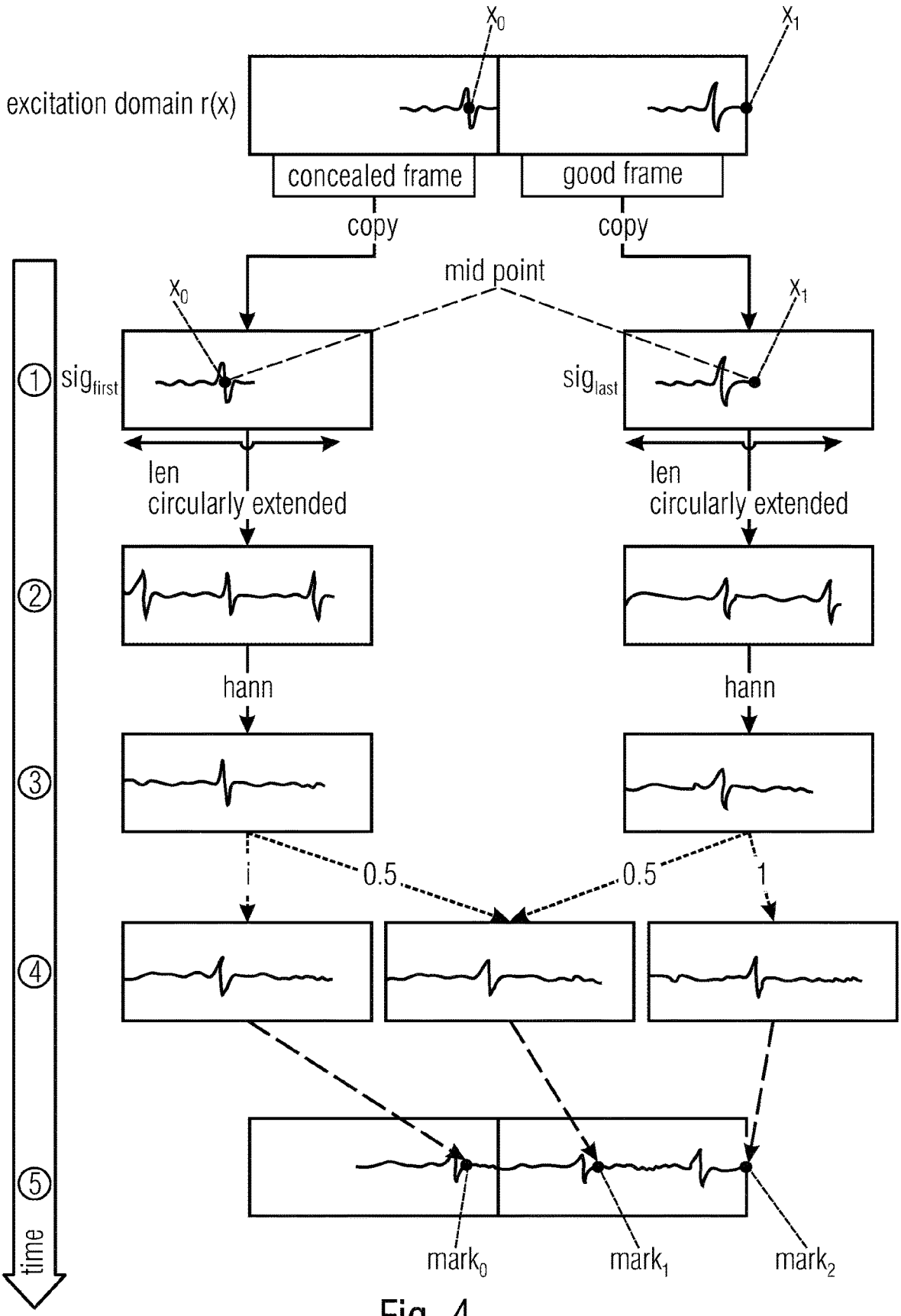
FIG. 4 illustrates a generation of two prototypes implementing pitch adapt overlap according to an embodiment.

The prototypes are cut out from the excitation signal r (x) with the lengths $T_c$ and $T_g$ in such a way, that $x_0$ and $x_1$ are set on the mid points of $sig_{first}$ and $sig_{last}$ (see step 1 in FIG. 4). Then, they are circularly extended, to reach the length len (see step 2 in FIG. 4). Afterwards, they are windowed with a hann window (see step 3 in FIG. 4), to avoid artefacts in the overlap regions.

The prototype for the marker i is calculated as follows (see step 4 in FIG. 4):

$$sig_i = (1 - \alpha) \cdot sig_{first} + \alpha \cdot sig_{last}$$

where $$\alpha = \frac{i}{nrOfMarkers}$$

Then, the prototypes are set with the mid point at the corresponding marker positions and added up (see step 5 in FIG. 4).

Finally, the constructed signal is first filtered with the LPC synthesis filter with the filter parameters A and then filtered with the de-emphasis filter to be back in the original signal domain.

The signal is crossfaded with the original decoded signal, to prevent artefacts on the frame borders.

FIG. 4 illustrates a generation of two prototypes according to such an embodiment.

For safety reason, energy damping, e.g., as described below, should be applied on the crossfaded signal to remove the risk of energy high increases in the recovery frame.

Regarding the cut out of the prototypes for $x_0$ and $x_1$ mentioned above, $x_0$ and $x_1$ are the points-in-time, when both residual signals have highest similarity. $sig_{first}$ and $sig_{last}$, the prototypes for $x_0$ and $x_1$, have len="twice the smallest marker distance minus 1". Thus, the length is odd, which results in that $sig_{first}$ and $sig_{last}$ have one midpoint. The residual signals with length $T_c$ (of the concealed frame) and with length $T_g$ (of the good frame) are now placed such that $x_0$ is located on the midpoint of $sig_{first}$, and such that $x_1$ is located on the midpoint of $sig_{last}$. Afterwards they may be circularly extended to fill all samples from 1 to len of $sig_{first}$ and $sig_{last}$.

In the following, excitation overlap according to embodiments is described.

FIG. 1*c* illustrates an apparatus 200 for improving a transition from a concealed audio signal portion of an audio signal to a succeeding audio signal portion of the audio signal according to another embodiment. The apparatus of FIG. 1*c* implements an excitation overlap concept.

The apparatus 200 of FIG. 1*c* is a particular embodiment of the apparatus 10 of FIG. 1*a*. The processor 210 of FIG. 1*c* is a particular embodiment of the processor 11 of FIG. 1*a*.

The output interface 220 of FIG. 1*c* is a particular embodiment of the output interface 12 of FIG. 1*a*.

In FIG. 1*c*, the processor 210 may, e.g., be configured to generate a first extended signal portion depending on the first sub-portion, so that the first extended signal portion is different from the first audio signal portion, and so that the first extended signal portion has more samples that the first sub-portion.

Furthermore, the processor 210 of FIG. 1*c* may, e.g., be configured to generate the decoded audio signal portion using the first extended signal portion and using the second audio signal portion.

According to an embodiment, the processor 210 is configured to generate the decoded audio signal portion by conducting crossfading of the first extended signal portion with the second audio signal portion to obtain a crossfaded signal portion.

In an embodiment, the processor 210 may, e.g., be configured to generate the first sub-portion from the first audio signal portion such that a length of the first sub-portion is equal to a pitch lag of the first audio signal portion ($T_c$).

According to an embodiment, the processor 210 may, e.g., be configured to generate the first extended signal portion such that a number of samples of the first extended signal portion is equal to the number of samples of said pitch lag of the first audio signal portion plus a number of samples of the second audio signal portion ($T_c$+number of samples of second audio signal portion).

In an embodiment, the processor 210 may, e.g., be configured to determine the first audio signal portion depending on the concealed audio signal portion and depending on a plurality of filter coefficients, wherein the plurality of filter coefficients depends on the concealed audio signal portion. Moreover, the processor 210 may, e.g., be configured to determine the second audio signal portion depending on the succeeding audio signal portion and on the plurality of filter coefficients.

According to an embodiment, the processor 210 may, e.g., comprise a filter. Moreover, the processor 210 may, e.g., be configured to apply the filter with the filter coefficients on the concealed audio signal portion to obtain the first audio signal portion. Furthermore, the processor 210 may, e.g., be configured to apply the filter with the filter coefficients on the succeeding audio signal portion to obtain the second audio signal portion.

In an embodiment, the filter coefficients of the plurality of filter coefficients may, e.g., be Linear Predictive Coding parameters of a Linear Predictive Filter.

According to an embodiment, the processor 210 may, e.g., be configured to apply a cosine window defined by $$w(x) = \begin{cases} 0.54 - 0.46 \cdot \cos\left(\frac{2\pi x}{2x_1 - 1}\right), & x = 0 \ldots x_1 - 1 \\ \cos\left(\frac{2\pi(x - x_1)}{4x_2 - 1}\right), & x = x_1 \ldots x_1 + x_2 - 1 \end{cases}$$

on the concealed audio signal portion to obtain a concealed windowed signal portion. The processor 210 may, e.g., be configured to determine the plurality of filter coefficients depending on the concealed windowed signal portion, wherein each of x and $x_1$ and $x_2$ is a sample position of the plurality of sample positions.

Figure 5:
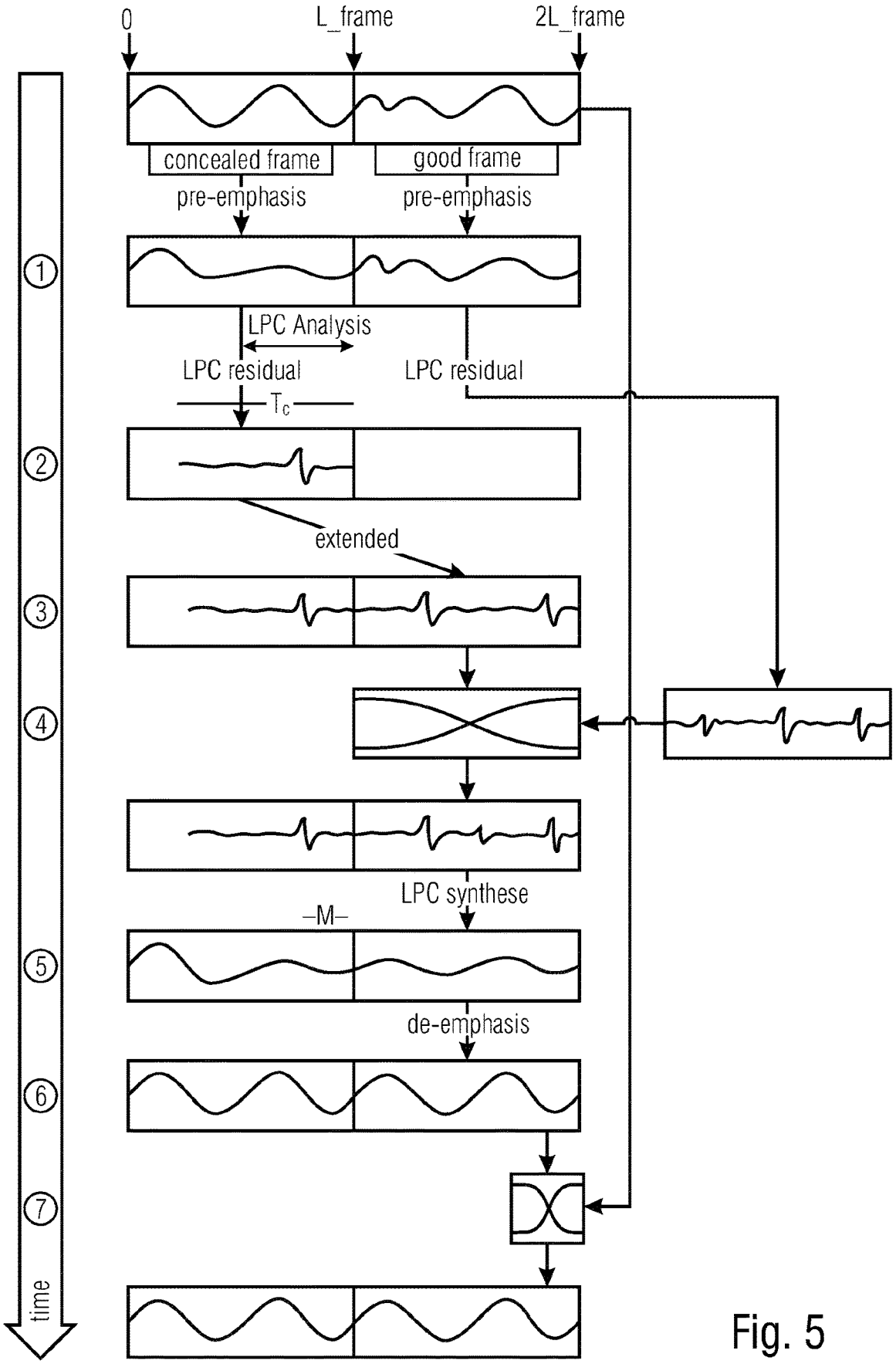
FIG. 5 illustrates excitation overlap according to an embodiment.

FIG. 5 illustrates excitation overlap according to such an embodiment.

An apparatus implementing excitation overlap is doing a crossfading in the excitation domain between a forward repetition of the concealed frame with the decoded signal to slowly smooth between the two signals.

An apparatus or a method according to such embodiments, may, for example, be realized as follows:

First, a 16 order LPC Analysis is done on the pre-emphased end of the previous frame (see step 1 in FIG. 5) with a hamming-cosine window same as done in the pitch adapt overlap method.

The LPC filter is applied to get the excitation signals in the concealed frame and the first good frame (see step 2 in FIG. 5)

To build the recovery frame, the last Tc samples of the excitation of the concealed frame are forward repeated to create on full frame length (see step 3 in FIG. 5). This will be used to be overlapped with the first good frame The extended excitation is than crossfaded with the excitation in the first good frame (see step 4 in FIG. 5)

Afterwards, the LPC synthesis is applied on the crossfaded signal (see step 5 in FIG. 5) with the memories being the last pre-emphased samples of the concealed frame, to smooth the transition between concealed and first good frame Finally, the de-emphasis filter is applied on the synthesized signal (see step 6 in FIG. 5) to get the signal back in the original domain The new constructed signal is crossfaded with the original decoded signal (see step 7 in FIG. 5), to prevent artefacts at the frame borders.

In the following, energy damping according to embodiments is described.

FIG. 1*d* illustrates embodiments, wherein the first audio signal portion is the concealed audio signal portion, wherein the second audio signal portion is the succeeding audio signal portion.

The apparatus 300 of FIG. 1*d* is a particular embodiment of the apparatus 10 of FIG. 1*a*. The processor 310 of FIG. 1*d* is a particular embodiment of the processor 11 of FIG. 1*a*. The output interface 320 of FIG. 1*d* is a particular embodiment of the output interface 12 of FIG. 1*a*.

The processor 310 of FIG. 1*d* may, e.g., be configured to determine a first sub-portion of the concealed audio signal portion, being the first sub-portion of the first audio signal portion, such that the first sub-portion comprises one or more of the samples of the concealed audio signal portion, but comprises fewer samples than the concealed audio signal portion, and such that each sample position of the samples of the first sub-portion is a successor of any sample position of any sample of the concealed audio signal portion that is not comprised by the first sub-portion.

Moreover, the processor 310 of FIG. 1*d* may, e.g., be configured to determine a third sub-portion of the succeeding audio signal portion, such that the third sub-portion comprises one or more of the samples of the succeeding audio signal portion, but comprises fewer samples than the succeeding audio signal portion, and such that each sample position of each of the samples of the third sub-portion is a successor of any sample position of any sample of the succeeding audio signal portion that is not comprised by the third sub-portion.

Furthermore, the processor 310 of FIG. 1*d* may, e.g., be configured to determine a second sub-portion of the succeeding audio signal portion, being the second sub-portion of the second audio signal portion, such that any sample of the succeeding audio signal portion which is not comprised by the third sub-portion is comprised by the second sub-portion of the succeeding audio signal portion.

In the embodiments according to FIG. 1*d*, the processor 310 may, e.g., be configured to determine a first peak sample from the samples of the first sub-portion of the concealed audio signal portion, such that the sample value of the first peak sample is greater than or equal to any other sample value of any other sample of the first sub-portion of the concealed audio signal portion. The processor 310 of FIG. 1*d* may, e.g., be configured to determine a second peak sample from the samples of the second sub-portion of the succeeding audio signal portion, such that the sample value of the second peak sample is greater than or equal to any other sample value of any other sample of the second sub-portion of the succeeding audio signal portion. Moreover, the processor 310 of FIG. 1*d* may, e.g., be configured to determine a third peak sample from the samples of the third sub-portion of the succeeding audio signal portion, such that the sample value of the third peak sample is greater than or equal to any other sample value of any other sample of the third sub-portion of the succeeding audio signal portion.

If and only if a condition is fulfilled, the processor 310 of FIG. 1*d* may, e.g., be configured to modify each sample value of each sample of the succeeding audio signal portion that is a predecessor of the second peak sample, to generate the decoded audio signal portion.

The condition may, e.g., be that both the sample value of the second peak sample is greater than the sample value of the first peak sample and that the sample value of the second peak sample is greater than the sample value of the third peak sample.

Or, the condition may, e.g., be that both a first ratio between the sample value of the second peak sample and the sample value of the first peak sample is greater than a first threshold value, and a second ratio between the sample value of the second peak sample and the sample value of the third peak sample is greater than a second threshold value.

According to an embodiment, the condition may, e.g., be that both the sample value of the second peak sample is greater than the sample value of the first peak sample and that the sample value of the second peak sample is greater than the sample value of the third peak sample.

In an embodiment, the condition may, e.g., be that both the first ratio is greater than the first threshold value, and the second ratio is greater than the second threshold value.

According to an embodiment, the first threshold value may, e.g., be greater than 1.1, and the second threshold value may, e.g., be greater than 1.1.

In an embodiment, the first threshold value may, e.g., be equal to the second threshold value.

According to an embodiment, if and only if the condition is fulfilled, the processor 310 may, e.g., be configured to modify each sample value of each sample of the succeeding audio signal portion that is a predecessor of the second peak sample according to $$s_{modified}(L\text{frame}+i)=s(L\text{frame}+i)\cdot\alpha_i$$

wherein Lframe indicates a sample position of a sample of the succeeding audio signal portion which is a predecessor for any other sample position of any other sample of the succeeding audio signal portion, wherein Lframe+i is an integer indicating the sample position of the i+1-th sample of the succeeding audio signal portion, wherein $0 \le i \le I_{max}-1$, wherein $I_{max}-1$ indicates a sample position of the second peak sample, wherein s(Lframe+i) is a sample value of the i+1-th sample of the succeeding audio signal portion before being modified by the processor 310, wherein $s_{modified}$(Lframe+i) is a sample value of the i+1-th sample of the succeeding audio signal portion after being modified by the processor 310, wherein $0<\alpha_i<1$.

In an embodiment, $$\alpha_i = \frac{\frac{\max(E_{cmax}, E_{gmax})}{E_{max}} - 1}{I_{max} - 1} \cdot i + 1$$

wherein $E_{cmax}$ is the sample value of the first peak sample, wherein $E_{max}$ is the sample value of the second peak sample, and wherein $E_{gmax}$ is the sample value of the third peak sample.

According to an embodiment, if and only if the condition is fulfilled, the processor 310 may, e.g., be configured to modify a sample value of each sample of two or more samples of the plurality of samples of the succeeding audio signal portion which are successors of the second peak sample, to generate the decoded audio signal portion according to $$s_{modified}(I\text{max}+k)=s(I\text{max}+k)\cdot\alpha_i.$$

wherein Imax+k is an integer indicating the sample position of the Imax+k+1-th sample of the succeeding audio signal portion.

Figure 6:
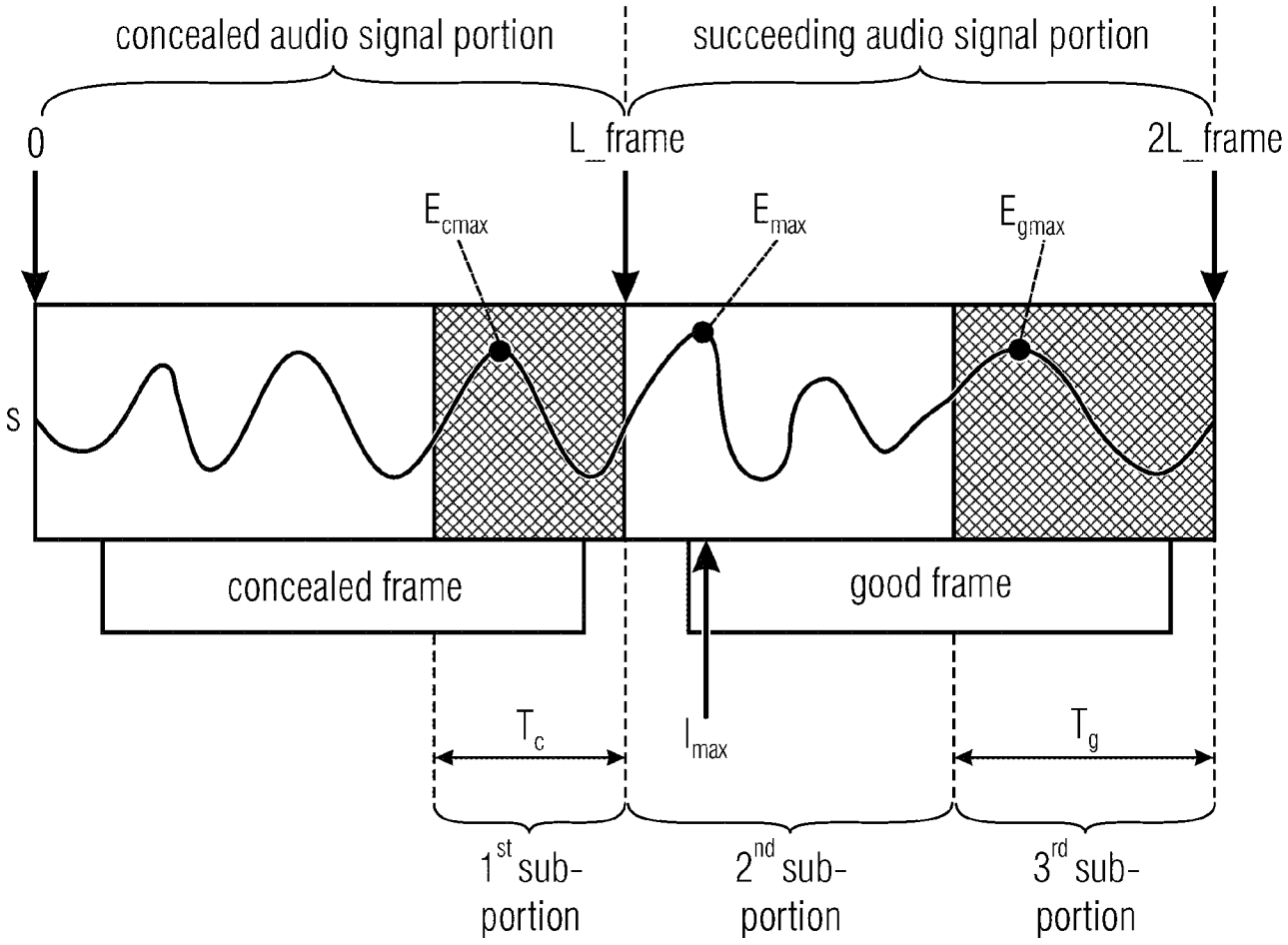
FIG. 6 illustrates a concealed frame and a good frame according to an embodiment.

FIG. 6 is a further illustration of a concealed frame and a good frame according to an embodiment. Inter alia, FIG. 6 illustrates the concealed audio signal portion, the succeeding audio signal portion, the first sub-portion, the second sub-portion and the third sub-portion.

Energy damping is used to remove high energy increases in the overlapping part of the signal between the last concealed frame and the first good frame. This is done by slowly damping the signal region to a peak amplitude value.

An approach according to an embodiment may, for example, be implemented as follows:

Find maximum amplitude values in:

the last $T_c$ samples of the previous concealed frame: $E_{cmax}$ the last $T_g$ samples in the first good frame: $E_{gmax}$ and in between these region: $E_{max}$ $E_{max}$ is the first peak sample, $E_{max}$ is the second peak sample and $E_{gmax}$ is the third peak sample.

The decoded signal in the first good frame will then be damped, if $$E_{cmax}<E_{max}>E_{gmax}$$

In other embodiments, the first good frame will be damped, if $$\left(\frac{E_{max}}{E_{cmax}} > thresholdValue1 \text{ and } \frac{E_{max}}{E_{gmax}} > thresholdValue2\right)$$

For example, 1.1<thresholdValue1<4 and 1.1<thresholdValue2<4

The first part of the decoded signal will be damped as follows:

$$S_{Lframe+i}=S_{Lframe+i}\cdot\alpha_i, i=0 \ldots I_{max}-1$$

where $I_{max}$ is the index of $E_{max}$ and $$\alpha_i = \frac{\frac{\max(E_{cmax}, E_{gmax})}{E_{max}} - 1}{I_{max} - 1} \cdot i + 1$$

The second part will be damped as follows:

$$S_{l_{max}+i} = S_{l_{max}+i} \cdot \alpha_i,\ i = 0 \ldots L_{frame} - l_{max} - 1$$

where $$\alpha_i = \frac{1 - \frac{\max(E_{cmax}, E_{gmax})}{E_{max}}}{L_{frame} - l_{max} - 1} \cdot i + \frac{\max(E_{cmax}, E_{gmax})}{E_{max}}$$

In embodiments, for safety reason, energy damping may, e.g., be applied on the crossfaded signal to remove the risk of energy high increases in the recovery frame.

Now, combinations of the different improved transition concepts according to embodiments are provided.

Figure 7A:
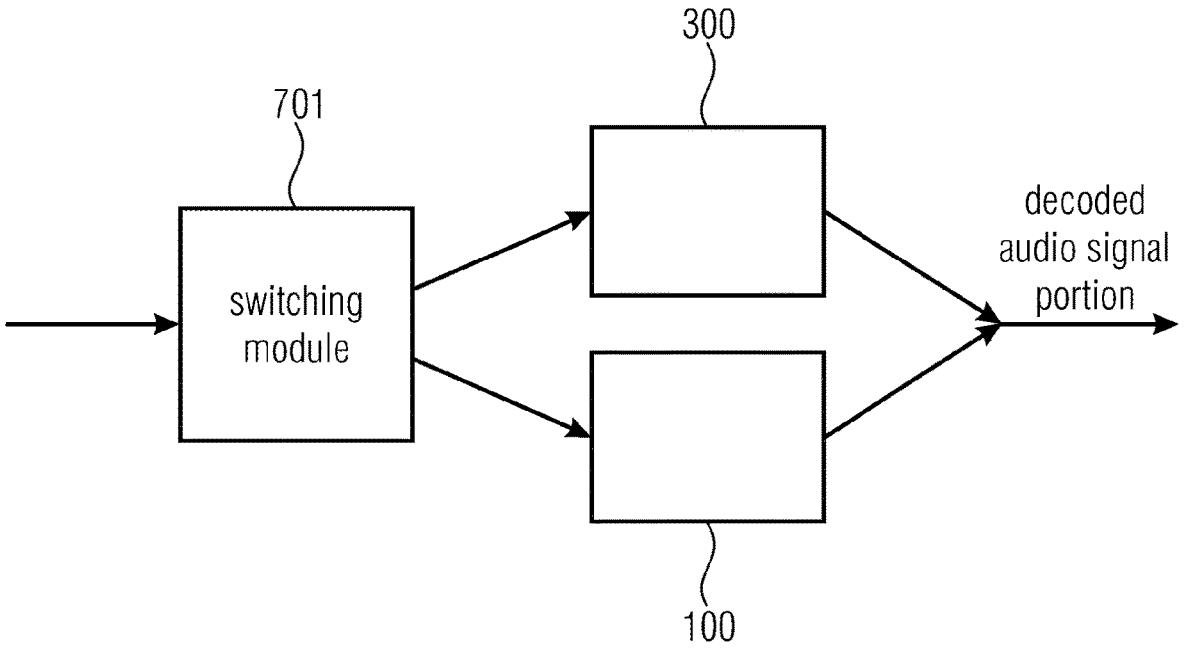
FIG. 7*a* illustrates a system according to an embodiment.

FIG. 7*a* illustrates system for improving a transition from a concealed audio signal portion of an audio signal to a succeeding audio signal portion of the audio signal according to an embodiment.

The system comprises a switching module 701, an apparatus 300 for implementing energy damping as described above with reference to FIG. 1*d* and an apparatus 100 for implementing pitch adapt overlap as described above with reference to FIG. 1*b*.

The switching module 701 is configured to choose, depending on the concealed audio signal portion and depending on the succeeding audio signal portion, one of the apparatus 300 for implementing energy damping and of the apparatus 100 for implementing pitch adapt overlap for generating the decoded audio signal portion.

Figure 7B:
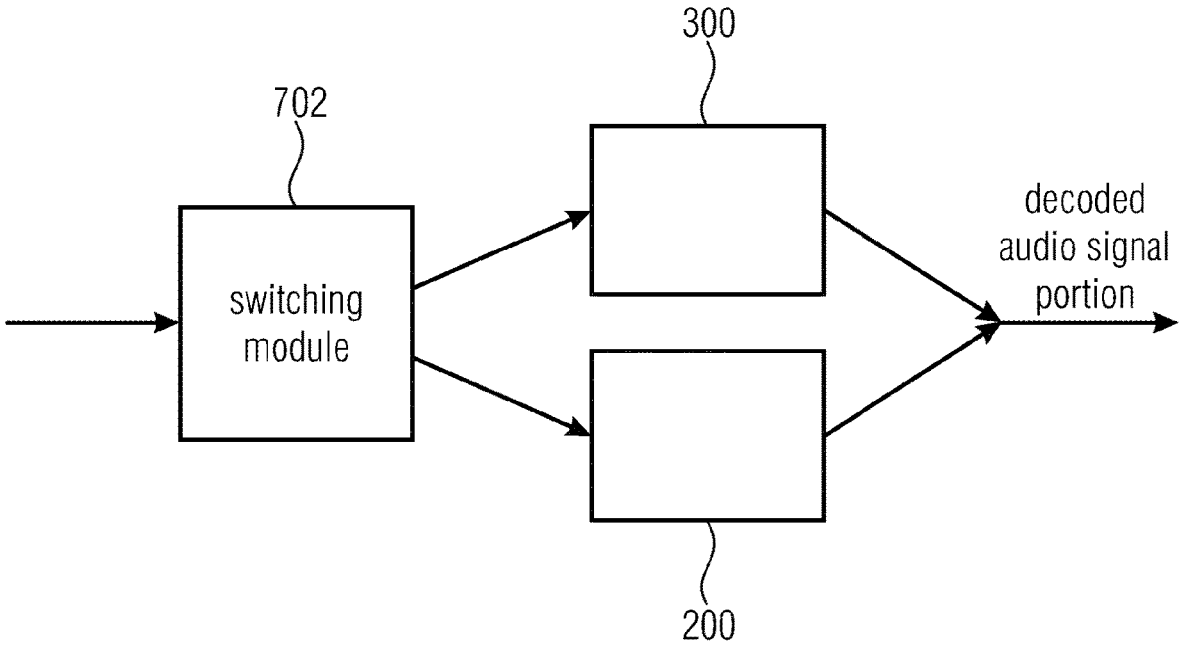
FIG. 7*b* illustrates a system according to another embodiment.

FIG. 7*b* illustrates system for improving a transition from a concealed audio signal portion of an audio signal to a succeeding audio signal portion of the audio signal according to another embodiment.

The system comprises a switching module 702, an apparatus 300 for implementing energy damping as described above with reference to FIG. 1*d* and an apparatus 200 for implementing excitation overlap as described above with reference to FIG. 1*c*.

The switching module 702 is configured to choose, depending on the concealed audio signal portion and depending on the succeeding audio signal portion, one of the apparatus 300 for implementing energy damping and of the apparatus 200 for implementing excitation overlap for generating the decoded audio signal portion.

Figure 7C:
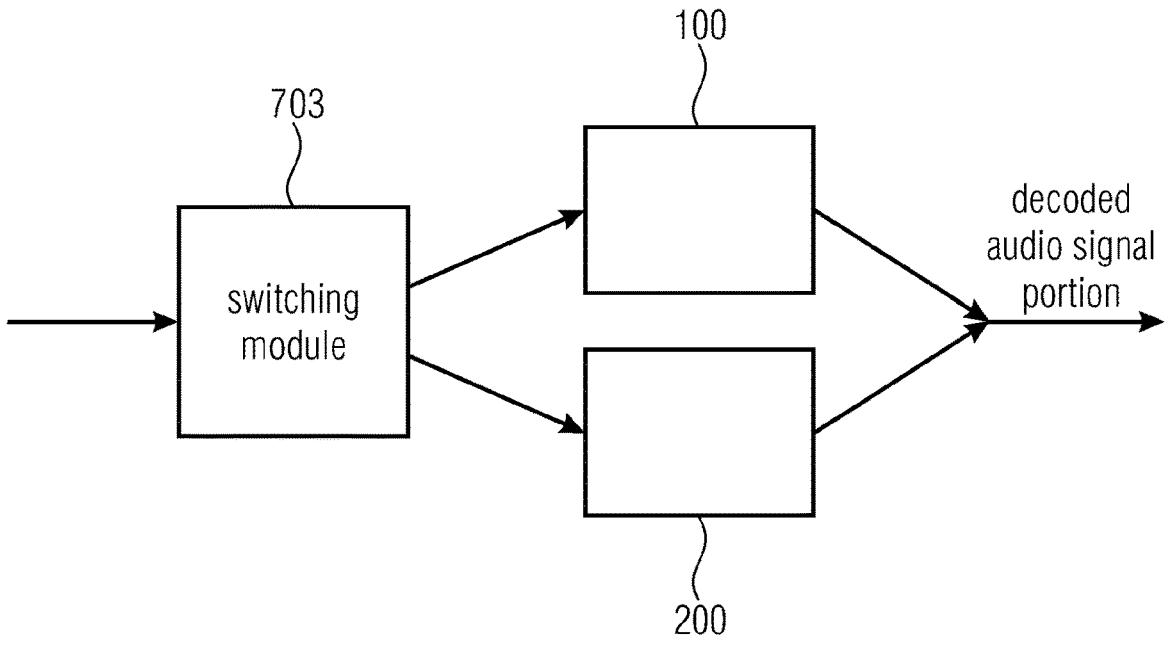
FIG. 7*c* illustrates a system according to a further embodiment.

FIG. 7*c* illustrates system for improving a transition from a concealed audio signal portion of an audio signal to a succeeding audio signal portion of the audio signal according to a further embodiment.

The system comprises a switching module 703, an apparatus 100 for implementing pitch adapt overlap as described above with reference to FIG. 1*b* and an apparatus 200 for implementing excitation overlap as described above with reference to FIG. 1*c*.

The switching module 703 is configured to choose, depending on the concealed audio signal portion and depending on the succeeding audio signal portion, one of the apparatus 100 for implementing pitch adapt overlap and of the apparatus 200 for implementing excitation overlap for generating the decoded audio signal portion.

Figure 7D:
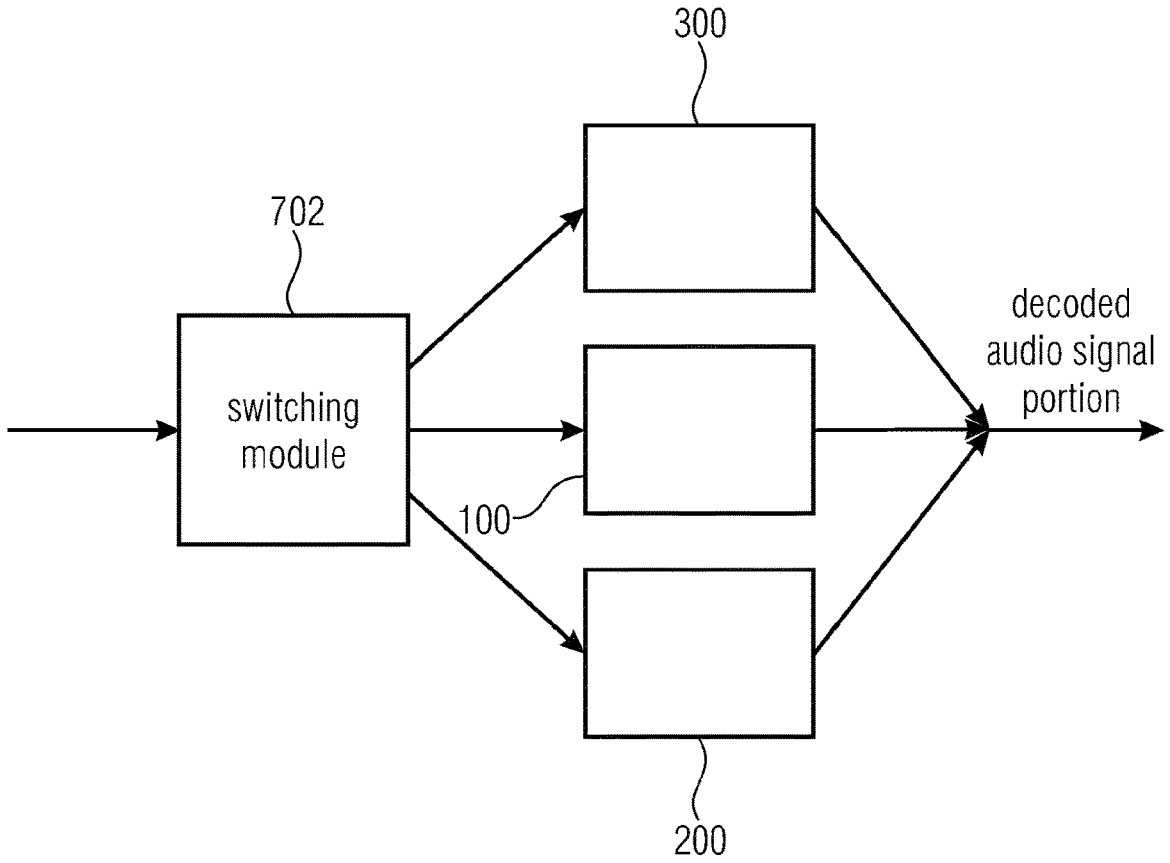
FIG. 7*d* illustrates a system according to a still further embodiment.

FIG. 7*d* illustrates system for improving a transition from a concealed audio signal portion of an audio signal to a succeeding audio signal portion of the audio signal according to a still further embodiment.

The system comprises a switching module 701, an apparatus 300 for implementing energy damping as described above with reference to FIG. 1*d*, an apparatus 100 for implementing pitch adapt overlap as described above with reference to FIG. 1*b*, and an apparatus 200 for implementing excitation overlap as described above with reference to FIG. 1*c*.

The switching module 701 is configured to choose, depending on the concealed audio signal portion and depending on the succeeding audio signal portion, one of the apparatus 300 for implementing energy damping and of the apparatus 100 for implementing pitch adapt overlap and of the apparatus 200 for implementing excitation overlap for generating the decoded audio signal portion.

According to embodiments, the switching module 704 may, e.g., be configured to determine whether or not at least one of the concealed audio signal frame and the succeeding audio signal frame comprises speech. Moreover, the switching module 704 may, e.g., be configured to choose the apparatus 300 for implementing energy damping for generating the decoded audio signal portion, if the concealed audio signal frame and the succeeding audio signal frame do not comprise speech.

In embodiments, the switching module 704 may, e.g., be configured to choose said one of the apparatus 100 for implementing pitch adapt overlap and of the apparatus 200 for implementing excitation overlap and of the apparatus 300 for implementing energy damping for generating the decoded audio signal portion depending on a frame length of a succeeding audio signal frame and depending on at least one of a pitch of the concealed audio signal portion or a pitch of the succeeding audio signal portion, wherein the succeeding audio signal portion is an audio signal portion of the succeeding audio signal frame.

Figure 7E:
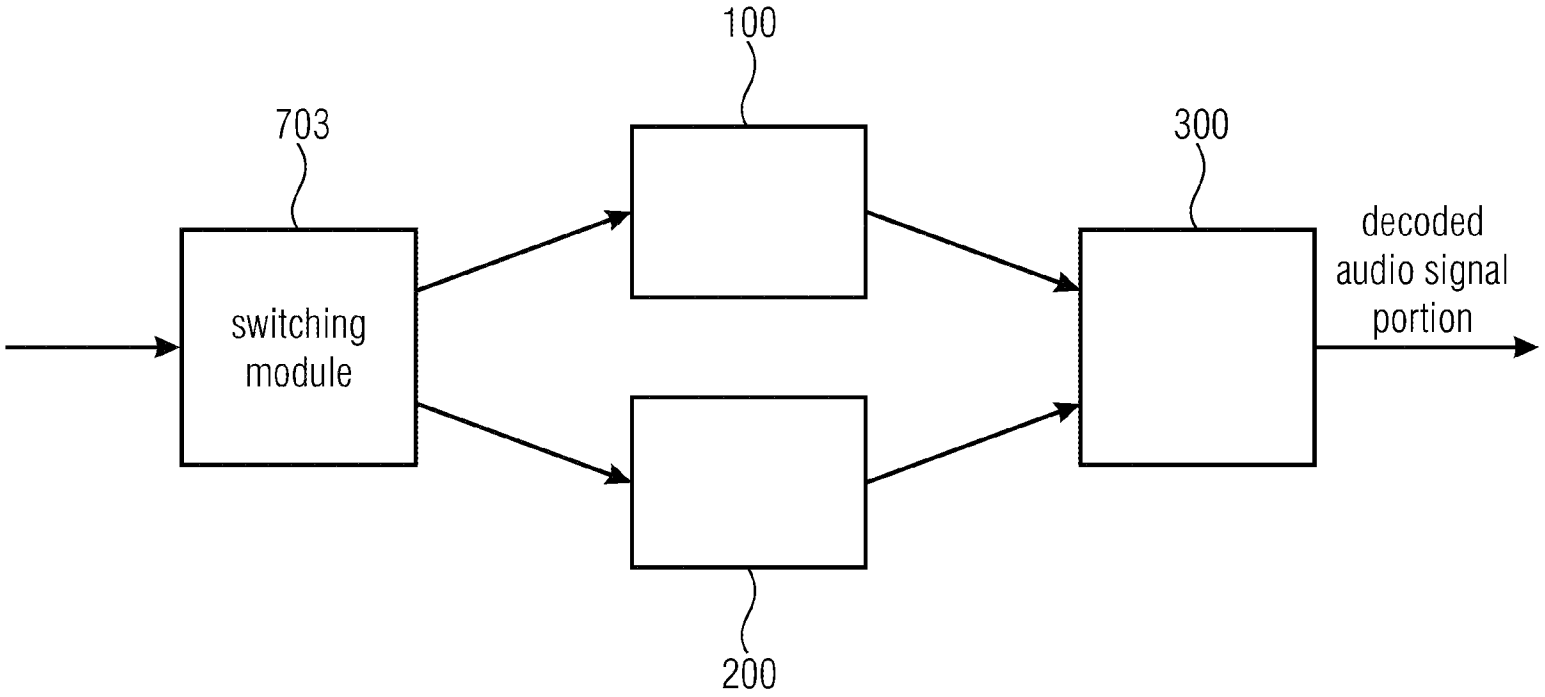
FIG. 7*e* illustrates a system according to another embodiment.

FIG. 7*e* illustrates system for improving a transition from a concealed audio signal portion of an audio signal to a succeeding audio signal portion of the audio signal according to a further embodiment.

As in FIG. 7*c*, the system of FIG. 7*e* comprises a switching module 703, an apparatus 100 for implementing pitch adapt overlap as described above with reference to FIG. 1*b* and an apparatus 200 for implementing excitation overlap as described above with reference to FIG. 1*c*.

The switching module 703 is configured to choose, depending on the concealed audio signal portion and depending on the succeeding audio signal portion, one of the apparatus 100 for implementing pitch adapt overlap and of the apparatus 200 for implementing excitation overlap for generating the decoded audio signal portion.

Moreover, the system of FIG. 7*e* further comprises an apparatus 300 for implementing energy damping as described above with reference to FIG. 1*d*.

The switching module 703 of FIG. 7*e* may, e.g., be configured to choose, depending on the concealed audio signal portion and depending on the succeeding audio signal portion, said one of the apparatus 100 for implementing pitch adapt overlap and of the apparatus 200 for implementing excitation overlap to generate an intermediate audio signal portion, In the embodiment of FIG. 7*e*, the apparatus 300 for implementing energy damping may, e.g., be configured to process the intermediate audio signal portion to generate the decoded audio signal portion.

Now, particular embodiments are described. In particular, concepts for particular implementations of the switching modules 701, 702, 703 and 704 are provided.

For example, a first embodiment providing a combination of different improved transition concepts may, e.g., be employed for any transform domain codec:

The first step is to detect if the signal is speech like with a prominent pitch (example are clean speech items, speech with background noise or speech over music) or not.

If the signal is speech like then
find Pitch $T_c$ in last concealed frame
find Pitch $T_g$ in first good frame
if energy increase in overlap part with last concealed frame
if pitch of good frame differs with concealed pitch more than 3 samples
do recovery filter
else
do energy damping
otherwise
do energy damping If recovery filter is chosen above then:
if concealed pitch $T_c$ or good pitch $T_g$ is higher than frame length $L_{frame}$
do energy damping
else if concealed pitch or good pitch is higher than half frame length and the normalized cross correlation value xCorr is smaller than a threshold
do excitation overlap
else if concealed pitch or good pitch is lower than half frame length
apply pitch adapt overlap For example, at first, the concealed frame is tested for the existence of speech (whether speech exists may, e.g., be seen from the concealment technique). Later on, the good frame may, e.g., also be tested for the presence of speech, e.g., using the normalized cross correlation value xCorr.

The overlap part mentioned above may, e.g., be the $2^{nd}$ sub-portion illustrated, for example, in FIG. 6, that means the overlap part is the good frame from the first sample up to sample "Frame length minus $T_g$".

Now, a second embodiment providing a combination of different improved transition concepts is provided. Such a second embodiment may, e.g., be employed for the AAC-ELD codec where the two frame error concealment methods are a time-domain and a frequency-domain method.

The time-domain method is synthesizing the lost frame with a pitch extrapolation approach and is called TD PLC (see [8]).

The frequency-domain method is the state of the art concealment method for the AAC-ELD codec called Noise Substitution (NS), which is using a sign scrambled copy of the previous good frame.

In the second embodiment, a first division is made dependent on last concealment method:

If last frame was concealed with TD PLC:
find Pitch in first good frame
if energy increase in overlap part with last concealed frame
if pitch of good frame differs with concealed pitch more than 3 samples
do recovery filter
else
do energy damping
if last frame was concealed with NS:
do energy damping Moreover, in the second embodiment, a second division is made in the recovery filter as follows:

if concealed pitch $T_c$ (pitch in the last frame that was concealed) or good pitch $T_g$ (pitch in the first good frame) is higher than frame length $L_{frame}$
do energy damping
if concealed pitch or good pitch is higher than half frame length and the normalized cross correlation value xCorr is smaller than a threshold
do excitation overlap
if concealed pitch or good pitch is lower than half frame length
apply pitch adapt overlap A plurality of embodiments have been provided.

According to embodiments, a filter for improving a transition between a concealed lost frame of a transform-domain coded signal and one or more frames of the transform-domain coded signal succeeding the concealed lost frame is provided.

In embodiments, the filter may, e.g., be further configured according to the above description.

According to embodiments, at transform-domain decoder comprising a filter according to one of the above-described embodiments is provided.

Moreover, a method performed by a transform-domain decoder as described above is provided.

Furthermore, a computer program for performing a method as described above is provided.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, one or more of the most important method steps may be executed by such an apparatus.

Depending on certain implementation requirements, embodiments of the invention can be implemented in hardware or in software or at least partially in hardware or at least partially in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitory.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

The apparatus described herein may be implemented using a hardware apparatus, or using a computer, or using a combination of a hardware apparatus and a computer.

The methods described herein may be performed using a hardware apparatus, or using a computer, or using a combination of a hardware apparatus and a computer.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] Philippe Gournay: "*Improved Frame Loss Recovery Using Closed-Loop Estimation of Very Low Bit Rate Side Information*", Interspeech 2008, Brisbane, Australia, 22-26 Sep. 2008.

[2] Mohamed Chibani, Roch Lefebvre, Philippe Gournay: "*Resynchronization of the Adaptive Codebook in a Constrained CELP Codec after a frame erasure*", 2006 International Conference on Acoustics, Speech and Signal Processing (ICASSP'2006), Toulouse, FRANCE Mar. 14-19, 2006.

[3] S.-U. Ryu, E. Choy, and K. Rose, "*Encoder assisted frame loss concealment for MPEG-AAC decoder*", ICASSP IEEE Int. Conf. Acoust. Speech Signal Process Proc., vol. 5, pp. 169-172, May 2006.

[4] ISO/IEC 14496-3:2005/Amd 9:2008: Enhanced low delay AAC, available at: http://www.iso.org/iso/iso_catalogue/catalogue_tc/catalogue_detail.htm?csnumber=46457

[5] J. Lecomte, et al, "*Enhanced time domain packet loss concealment in switched speech/audio codec*", submitted to IEEE ICASSP, Brisbane, Australia, April 2015.

[6] E. Moulines and J. Laroche, "*Non-parametric techniques for pitch-scale and time-scale modification of speech*", Speech Communication, vol. 16, pp. 175-205, 1995.

[7] European Patent EP 363233 B1: *"Method and apparatus for speech synthesis by wave form overlapping and adding"*.

[8] International Patent Application WO 2015063045 A1: *"Audio Decoder and Method for Providing a Decoded Audio Information using an Error Concealment Modifying a Time Domain Excitation Signal"*.

[9] Schnell, M.; Schmidt, M.; Jander, M.; Albert, T.; Geiger, R.; Ruoppila, V.; Ekstrand, P.; Grill, B., "*MPEG-4 enhanced low delay AAC—a new standard for high quality communication*", Audio Engineering Society: 125th Audio Engineering Society Convention 2008; Oct. 2-5, 2008, San Francisco, USA.

The invention claimed is:

1. An apparatus for improving a transition from a concealed audio signal portion of an audio signal to a succeeding audio signal portion of the audio signal, wherein the apparatus comprises:

a processor being configured to generate a decoded audio signal portion of the audio signal depending on a first audio signal portion and depending on a second audio signal portion, wherein the first audio signal portion depends on the concealed audio signal portion, and wherein the second audio signal portion depends on the succeeding audio signal portion, and an output interface for outputting the decoded audio signal portion, wherein each of the first audio signal portion and of the second audio signal portion and of the decoded audio signal portion comprises a plurality of samples, wherein each of the plurality of samples of the first audio signal portion and of the second audio signal portion and of the decoded audio signal portion is defined by a sample position of a plurality of sample positions and by a sample value, wherein the plurality of sample positions is ordered such that for each pair of a first sample position of the plurality of sample positions and a second sample position of the plurality of sample positions, being different from the first sample position, the first sample position is either a successor or a predecessor of the second sample position, wherein the processor is configured to determine a first sub-portion of the first audio signal portion, such that the first sub-portion comprises fewer samples than the first audio signal portion, and wherein the processor is configured to generate the decoded audio signal portion using the first sub-portion of the first audio signal portion and using the second audio signal portion or a second sub-portion of the second audio signal portion, such that for each sample of two or more samples of the second audio signal portion, the sample position of said sample of the two or more samples of the second audio signal portion is equal to the sample position of one of the samples of the decoded audio signal portion, and such that the sample value of said sample of the two or more samples of the second audio signal portion is different from the sample value of said one of the samples of the decoded audio signal portion.

2. An apparatus according to claim 1, wherein the processor is configured to determine a second prototype signal portion, being the second sub-portion of the second audio signal portion, such that the second sub-portion comprises fewer samples than the second audio signal portion, and wherein the processor is configured to determine one or more intermediate prototype signal portions by determining each of the one or more intermediate prototype signal portions by combining a first prototype signal portion, being the first sub-portion, and the second prototype signal portion, wherein the processor is configured to generate the decoded audio signal portion using the first prototype signal portion and using the one or more intermediate prototype signal portions and using the second prototype signal portion.

3. An apparatus according to claim 2, wherein the processor is configured to generate the decoded audio signal portion by combining the first prototype signal portion and the one or more intermediate prototype signal portions and the second prototype signal portion.

4. An apparatus according to claim 2, wherein the processor is configured to determine a plurality of three or more marker sample positions, wherein each of the three or more marker sample positions is a sample position of at least one of the first audio signal portion and the second audio signal portion, wherein the processor is configured to choose a sample position of a sample of the second audio signal portion which is a successor for any other sample position of any other sample of the second audio signal portion as an end sample position of the three or more marker sample positions, wherein the processor is configured to determine a start sample position of the three or more marker sample positions by selecting a sample position from the first audio signal portion depending on a correlation between a first sub-portion of the first audio signal portion and a second sub-portion of the second audio signal portion, wherein the processor is configured to determine one or more intermediate sample positions of the three or more marker sample positions depending on the start sample position of the three or more marker sample positions and depending on the end sample position of the three or more marker sample positions, and wherein the processor is configured to determine the one or more intermediate prototype signal portions by determining for each of said one or more intermediate sample positions an intermediate prototype signal portion of the one or more intermediate prototype signal portions by combining the first prototype signal portion and the second prototype signal portion depending on said intermediate sample position.

5. An apparatus according to claim 4, wherein the processor is configured to determine the one or more intermediate prototype signal portions by determining for each of said one or more intermediate sample positions an intermediate prototype signal portion of the one or more intermediate prototype signal portions by combining the first prototype signal portion and the second prototype signal portion according to $$sig_i = (1-\alpha)\cdot sig_{first} + \alpha \cdot sig_{last}$$

where $$\alpha = \frac{i}{nrOfMarkers}$$

wherein i is an integer, with i≥1, wherein nrOfMarkers is the number of the three or more marker sample positions minus 1, wherein $sig_i$ is an i-th intermediate prototype signal portion of the one or more intermediate prototype signal portion, wherein $sig_{first}$ is the first prototype signal portion, wherein $sig_{last}$ is the second prototype signal portion.

6. An apparatus according to claim 4, wherein the processor is configured to determine the one or more intermediate sample positions of the three or more marker sample positions depending on $$mark_i = mark_{i-1} + T_c + \text{floor}\left(\frac{\delta \cdot j}{div} + 0.5\right),\ i = 1 \ldots nrOfMarkers - 1$$

or depending on $$mark_i = mark_{i+1} - T_c - \text{floor}\left(\frac{\delta \cdot j}{div} + 0.5\right),\ i = nrOfMarkers - 1 \ldots 1,\ j = 1 \ldots nrOfMarkers - 1,$$

wherein $nrOfMarkers = \text{floor}\left(\frac{x_1 - x_0}{T_c} + 0.5\right)$, wherein $\delta = x_1 - (x_0 + nrOfMarkers \cdot T_c)$, wherein $div = \frac{nrOfMarkers(nrOfMarkers+1)}{2}$, wherein i is an integer, with i≥1, wherein nrOfMarkers is the number of the three or more marker sample positions minus 1, wherein $mark_i$ is the i-th intermediate sample position of the three or more marker sample positions, wherein $mark_{i-1}$ is the i−1-th intermediate sample position of the three or more marker sample positions, wherein $mark_{i+1}$ is the i+1-th intermediate sample position of the three or more marker sample positions, wherein $x_0$ is the start sample position of the three or more marker sample positions, wherein $x_1$ is the end sample position of the three or more marker sample positions, and wherein $T_c$ indicates a pitch lag.

7. An apparatus according to claim 4, wherein the processor is configured to select as said first prototype signal portion, a sub-portion of a plurality of sub-portion candidates of the first audio signal portion depending on a plurality of correlations of each sub-portion of the plurality of sub-portion candidates of the first audio signal portion and of said second sub-portion of the second audio signal portion, wherein the processor is configured to select, as the start sample position of the three or more marker sample positions, a sample position of the plurality of samples of said first prototype signal portion which is a predecessor for any other sample position of any other sample of said first prototype signal portion.

8. An apparatus according to claim 7, wherein the processor is configured to select as said first prototype signal portion, the sub-portion of said sub-portion candidates, the correlation of which with said second sub-portion comprises a highest correlation value among said plurality of correlations.

9. An apparatus according to claim 7, wherein the processor is configured to determine for each correlation of the plurality of correlations a correlation value according to the formula, $$\sum_{i=1}^{T_g} \frac{r(2L_{frame}-i)r(L_{frame}-i-\Delta)}{\sqrt{r(2L_{frame}-i)^2 r(L_{frame}-i-\Delta)^2}},$$

wherein $L_{frame}$ indicates a number of samples of the second audio signal portion being equal to a number of samples of the first audio signal portion, wherein $r(2L_{frame}-i)$ indicates a sample value of a sample of the second audio signal portion at a sample position $2L_{frame}-i$, wherein $r(L_{frame}-i-\Delta)$ indicates a sample value of a sample of the first audio signal portion at a sample position $L_{frame}-i-\Delta$, wherein for each of the plurality of correlations of a sub-portion candidate of the plurality of sub-portion candidates and of said second sub-portion, $\Delta$ indicates a number and depends on said sub-portion candidate.

10. An apparatus according to claim 4, wherein the processor is configured to determine the first audio signal portion depending on the concealed audio signal portion and depending on a plurality of third filter coefficients, wherein the plurality of third filter coefficients depends on the concealed audio signal portion and on the succeeding audio signal portion, and wherein the processor is configured to determine the second audio signal portion depending on the succeeding audio signal portion and on the plurality of third filter coefficients.

11. An apparatus according to claim 10, wherein the processor comprises a filter, wherein the processor is configured to apply the filter with the third filter coefficients on the concealed audio signal portion to acquire the first audio signal portion, and wherein the processor is configured to apply the filter with the third filter coefficients on the succeeding audio signal portion to acquire the second audio signal portion.

12. An apparatus according to claim 10, wherein the processor is configured to determine a plurality of first filter coefficients depending on the concealed audio signal portion, wherein the processor is configured to determine a plurality of second filter coefficients depending on the succeeding audio signal portion, wherein the processor is configured to determine each of the third filter coefficients depending on a combination of one or more of the first filter coefficients and one or more of the second filter coefficients.

13. An apparatus according to claim 12, wherein the filter coefficients of the plurality of first filter coefficients and of the plurality of second filter coefficients and of the plurality of third filter coefficients are Linear Predictive Coding parameters of a Linear Predictive Filter.

14. An apparatus according to claim 12, wherein the processor is configured to determine each filter coefficient of the third filter coefficients according to the formula:

$$A=0.5\cdot A_{conc}+0.5\cdot A_{good}$$

wherein A indicates a filter coefficient value of said filter coefficient, wherein $A_{conc}$ indicates a coefficient value of a filter coefficient of the plurality of first filter coefficients, and wherein $A_{good}$ indicates a coefficient value of a filter coefficient of the plurality of second filter coefficients.

15. An apparatus according to claim 12, wherein the processor is configured to apply a cosine window defined by $$w(x)=\begin{cases} 0.54-0.46\cdot\cos\left(\frac{2\pi x}{2x_1-1}\right), & x=0\ \ldots\ x_1-1 \\ \cos\left(\frac{2\pi(x-x_1)}{4x_2-1}\right), & x=x_1\ \ldots\ x_1+x_2-1 \end{cases}$$

on the concealed audio signal portion to acquire a concealed windowed signal portion, wherein the processor is configured to apply said cosine window on the succeeding audio signal portion to acquire a succeeding windowed signal portion, wherein the processor is configured to determine the plurality of first filter coefficients depending on the concealed windowed signal portion, wherein the processor is configured to determine the plurality of second filter coefficients depending on the succeeding windowed signal portion, and wherein each of x and $x_1$ and $x_2$ is a sample position of the plurality of sample positions.

16. An apparatus according to claim 1, wherein the processor is configured to generate a first extended signal portion depending on the first sub-portion, so that the first extended signal portion is different from the first audio signal portion, and so that the first extended signal portion comprises more samples that the first sub-portion, wherein the processor is configured to generate the decoded audio signal portion using the first extended signal portion and using the second audio signal portion.

17. An apparatus according to claim 16, wherein the processor is configured to generate the decoded audio signal portion by conducting crossfading of the first extended signal portion with the second audio signal portion to acquire a crossfaded signal portion.

18. An apparatus according to claim 16, wherein the processor is configured to generate the first sub-portion from the first audio signal portion such that a length of the first sub-portion is equal to a pitch lag of the first audio signal portion.

19. An apparatus according to claim 18, wherein the processor is configured to generate the first extended signal portion such that a number of samples of the first extended signal portion is equal to the number of samples of said pitch lag of the first audio signal portion plus a number of samples of the second audio signal portion.

20. An apparatus according to claim 16, wherein the processor is configured to determine the first audio signal portion depending on the concealed audio signal portion and depending on a plurality of filter coefficients, wherein the plurality of filter coefficients depends on the concealed audio signal portion, and wherein the processor is configured to determine the second audio signal portion depending on the succeeding audio signal portion and on the plurality of filter coefficients.

21. An apparatus according to claim 20, wherein the processor comprises a filter, wherein the processor is configured to apply the filter with the filter coefficients on the concealed audio signal portion to acquire the first audio signal portion, and wherein the processor is configured to apply the filter with the filter coefficients on the succeeding audio signal portion to acquire the second audio signal portion.

22. An apparatus according to claim 21, wherein the filter coefficients of the plurality of filter coefficients are Linear Predictive Coding parameters of a Linear Predictive Filter.

23. An apparatus according to claim 20, wherein the processor is configured to apply a cosine window defined by $$w(x) = \begin{cases} 0.54 - 0.46 \cdot \cos\left(\frac{2\pi x}{2x_1 - 1}\right), & x = 0 \ldots x_1 - 1 \\ \cos\left(\frac{2\pi(x - x_1)}{4x_2 - 1}\right), & x = x_1 \ldots x_1 + x_2 - 1 \end{cases}$$

on the concealed audio signal portion to acquire a concealed windowed signal portion, wherein the processor is configured to determine the plurality of filter coefficients depending on the concealed windowed signal portion, wherein each of x and $x_1$ and $x_2$ is a sample position of the plurality of sample positions.

24. An apparatus according to claim 1, wherein the first audio signal portion is the concealed audio signal portion, wherein the second audio signal portion is the succeeding audio signal portion, wherein the processor is configured to determine a first sub-portion of the concealed audio signal portion, being the first sub-portion of the first audio signal portion, such that the first sub-portion comprises one or more of the samples of the concealed audio signal portion, but comprises fewer samples than the concealed audio signal portion, and such that each sample position of the samples of the first sub-portion is a successor of any sample position of any sample of the concealed audio signal portion that is not comprised by the first sub-portion, wherein the processor is configured to determine a third sub-portion of the succeeding audio signal portion, such that the third sub-portion comprises one or more of the samples of the succeeding audio signal portion, but comprises fewer samples than the succeeding audio signal portion, and such that each sample position of each of the samples of the third sub-portion is a successor of any sample position of any sample of the succeeding audio signal portion that is not comprised by the third sub-portion, wherein the processor is configured to determine a second sub-portion of the succeeding audio signal portion, being the second sub-portion of the second audio signal portion, such that any sample of the succeeding audio signal portion which is not comprised by the third sub-portion is comprised by the second sub-portion of the succeeding audio signal portion, wherein the processor is configured to determine a first peak sample from the samples of the first sub-portion of the concealed audio signal portion, such that the sample value of the first peak sample is greater than or equal to any other sample value of any other sample of the first sub-portion of the concealed audio signal portion, wherein the processor is configured to determine a second peak sample from the samples of the second sub-portion of the succeeding audio signal portion, such that the sample value of the second peak sample is greater than or equal to any other sample value of any other sample of the second sub-portion of the succeeding audio signal portion, wherein the processor is configured to determine a third peak sample from the samples of the third sub-portion of the succeeding audio signal portion, such that the sample value of the third peak sample is greater than or equal to any other sample value of any other sample of the third sub-portion of the succeeding audio signal portion, wherein, if and only if a condition is fulfilled, the processor is configured to modify each sample value of each sample of the succeeding audio signal portion that is a predecessor of the second peak sample, to generate the decoded audio signal portion, wherein the condition is that both the sample value of the second peak sample is greater than the sample value of the first peak sample and that the sample value of the second peak sample is greater than the sample value of the third peak sample, or wherein the condition is that both a first ratio between the sample value of the second peak sample and the sample value of the first peak sample is greater than a first threshold value, and a second ratio between the sample value of the second peak sample and the sample value of the third peak sample is greater than a second threshold value.

25. An apparatus according to claim 24, wherein the condition is that both the sample value of the second peak sample is greater than the sample value of the first peak sample and that the sample value of the second peak sample is greater than the sample value of the third peak sample.

26. An apparatus according to claim 24, wherein the condition is that both the first ratio is greater than the first threshold value and that the second ratio is greater than the second threshold value.

27. An apparatus according to claim 26, wherein the first threshold value is greater than 1.1, and wherein the second threshold value is greater than 1.1.

28. An apparatus according to claim 26, wherein the first threshold value is equal to the second threshold value.

29. An apparatus according to claim 24, wherein, if and only if the condition is fulfilled, the processor is configured to modify each sample value of each sample of the succeeding audio signal portion that is a predecessor of the second peak sample according to $$s_{modified}(Lframe+i)=s(Lframe+i)\cdot\alpha_i$$

wherein Lframe indicates a sample position of a sample of the succeeding audio signal portion which is a predecessor for any other sample position of any other sample of the succeeding audio signal portion, wherein Lframe+i is an integer indicating the sample position of the i+1-th sample of the succeeding audio signal portion, wherein $0 \le i \le Imax-1$, wherein $I_{max}-1$ indicates a sample position of the second peak sample, wherein s(Lframe+i) is a sample value of the i+1-th sample of the succeeding audio signal portion before being modified by the processor, wherein $s_{modified}$(Lframe+i) is a sample value of the i+1-th sample of the succeeding audio signal portion after being modified by the processor, wherein $0<\alpha_i<1$.

30. An apparatus according to claim 29, wherein $$\alpha_i = \frac{\frac{\max(E_{cmax}, E_{gmax})}{E_{max}} - 1}{I_{max} - 1} \cdot i + 1$$

wherein $E_{cmax}$ is the sample value of the first peak sample, wherein $E_{max}$ is the sample value of the second peak sample, wherein $E_{gmax}$ is the sample value of the third peak sample.

31. An apparatus according to claim 29, wherein, if and only if the condition is fulfilled, the processor is configured to modify a sample value of each sample of two or more samples of the plurality of samples of the succeeding audio signal portion which are successors of the second peak sample, to generate the decoded audio signal portion according to $s_{modified}(Imax+k)=s(Imax+k)\cdot\alpha_i$, wherein Imax+k is an integer indicating the sample position of the Imax+k+1-th sample of the succeeding audio signal portion.

32. An apparatus according to claim 1, wherein the apparatus further comprises a concealment unit, being configured to conduct concealment for a current frame that is erroneous or that got lost to acquire the concealed audio signal portion.

33. An apparatus according to claim 32, wherein the apparatus further comprises an activation unit that is configured to detect whether the current frame got lost or is erroneous, wherein the activation unit (6) is configured to activate the concealment unit to conduct the concealment for the current frame, if the current frame got lost or is erroneous.

34. An apparatus according to claim 33, wherein the activation unit is configured to detect whether a succeeding frame arrives that is not erroneous, if the current frame got lost or was erroneous, and wherein the activation unit is configured to activate the processor to generate the decoded audio signal portion, if the current frame got lost or is erroneous and if the succeeding frame arrives that is not erroneous.

35. A system for improving a transition from a concealed audio signal portion of an audio signal to a succeeding audio signal portion of the audio signal, wherein the system comprises:

a switching module, an apparatus according to claim 24 being an apparatus for implementing energy damping, and an apparatus wherein the processor is configured to determine a second prototype signal portion, being the second sub-portion of the second audio signal portion, such that the second sub-portion comprises fewer samples than the second audio signal portion, and wherein the processor is configured to determine one or more intermediate prototype signal portions by determining each of the one or more intermediate prototype signal portions by combining a first prototype signal portion, being the first sub-portion, and the second prototype signal portion, wherein the processor is configured to generate the decoded audio signal portion using the first prototype signal portion and using the one or more intermediate prototype signal portions and using the second prototype signal portion, said apparatus being an apparatus for pitch adapt overlap, wherein the switching module is configured to choose, depending on the concealed audio signal portion and depending on the succeeding audio signal portion, one of the apparatus for implementing energy damping and of the apparatus for implementing pitch adapt overlap for generating the decoded audio signal portion.

36. A system for improving a transition from a concealed audio signal portion of an audio signal to a succeeding audio signal portion of the audio signal, wherein the system comprises:

a switching module, an apparatus according to claim 24 being an apparatus for implementing energy damping, and an apparatus wherein the processor is configured to generate a first extended signal portion depending on the first sub-portion, so that the first extended signal portion is different from the first audio signal portion, and so that the first extended signal portion comprises more samples that the first sub-portion, wherein the processor is configured to generate the decoded audio signal portion using the first extended signal portion and using the second audio signal portion, said apparatus being an apparatus for implementing excitation overlap, wherein the switching module is configured to choose, depending on the concealed audio signal portion and depending on the succeeding audio signal portion, one of the apparatus for implementing energy damping and of the apparatus for implementing excitation overlap for generating the decoded audio signal portion.

37. A system for improving a transition from a concealed audio signal portion of an audio signal to a succeeding audio signal portion of the audio signal, wherein the system comprises:

a switching module, an apparatus according to claim 24 being an apparatus for implementing pitch adapt overlap, and an apparatus wherein the processor is configured to generate a first extended signal portion depending on the first sub-portion, so that the first extended signal portion is different from the first audio signal portion, and so that the first extended signal portion comprises more samples that the first sub-portion, wherein the processor is configured to generate the decoded audio signal portion using the first extended signal portion and using the second audio signal portion, said apparatus being an apparatus for implementing excitation overlap, wherein the switching module is configured to choose, depending on the concealed audio signal portion and depending on the succeeding audio signal portion, one of the apparatus for implementing pitch adapt overlap and of the apparatus for implementing excitation overlap for generating the decoded audio signal portion.

38. A system according to claim 37, wherein the system further comprises an apparatus according to claim 24 being an apparatus for implementing energy damping, wherein the switching module is configured to choose, depending on the concealed audio signal portion and depending on the succeeding audio signal portion, said one of the apparatus for implementing pitch adapt overlap and of the apparatus for implementing excitation overlap to generate an intermediate audio signal portion, wherein the apparatus for implementing energy damping is configured to process the intermediate audio signal portion to generate the decoded audio signal portion.

39. A non-transitory digital storage medium having a computer program stored thereon to perform the method for improving a transition from a concealed audio signal portion of an audio signal to a succeeding audio signal portion of the audio signal, wherein the method comprises:

generating a decoded audio signal portion of the audio signal depending on a first audio signal portion and depending on a second audio signal portion, wherein the first audio signal portion depends on the concealed audio signal portion, and wherein the second audio signal portion depends on the succeeding audio signal portion, and outputting the decoded audio signal portion, wherein each of the first audio signal portion and of the second audio signal portion and of the decoded audio signal portion comprises a plurality of samples, wherein each of the plurality of samples of the first audio signal portion and of the second audio signal portion and of the decoded audio signal portion is defined by a sample position of a plurality of sample positions and by a sample value, wherein the plurality of sample positions is ordered such that for each pair of a first sample position of the plurality of sample positions and a second sample position of the plurality of sample positions, being different from the first sample position, the first sample position is either a successor or a predecessor of the second sample position, wherein generating the decoded audio signal comprises determining a first sub-portion of the first audio signal portion, such that the first sub-portion comprises fewer samples than the first audio signal portion, wherein generating the decoded audio signal portion is conducted using the first sub-portion of the first audio signal portion and using the second audio signal portion or a second sub-portion of the second audio signal portion, such that for each sample of two or more samples of the second audio signal portion, the sample position of said sample of the two or more samples of the second audio signal portion is equal to the sample position of one of the samples of the decoded audio signal portion, and such that the sample value of said sample of the two or more samples of the second audio signal portion is different from the sample value of said one of the samples of the decoded audio signal portion, when said computer program is run by a computer.

40. A system for improving a transition from a concealed audio signal portion of an audio signal to a succeeding audio signal portion of the audio signal, wherein the system comprises:

a switching module, an apparatus wherein the processor is configured to determine a second prototype signal portion, being the second sub-portion of the second audio signal portion, such that the second sub-portion comprises fewer samples than the second audio signal portion, and wherein the processor is configured to determine one or more intermediate prototype signal portions by determining each of the one or more intermediate prototype signal portions by combining a first prototype signal portion, being the first sub-portion, and the second prototype signal portion, wherein the processor is configured to generate the decoded audio signal portion using the first prototype signal portion and using the one or more intermediate prototype signal portions and using the second prototype signal portion, said apparatus being an apparatus for implementing pitch adapt overlap, an apparatus wherein the processor is configured to generate a first extended signal portion depending on the first sub-portion, so that the first extended signal portion is different from the first audio signal portion, and so that the first extended signal portion comprises more samples that the first sub-portion, wherein the processor is configured to generate the decoded audio signal portion using the first extended signal portion and using the second audio signal portion, said apparatus being an apparatus for implementing excitation overlap, and an apparatus according to claim 24 being an apparatus for implementing energy damping, wherein the switching module is configured to choose, depending on the concealed audio signal portion and depending on the succeeding audio signal portion, one of the apparatus for implementing pitch adapt overlap and of the apparatus for implementing excitation overlap and of the apparatus for implementing energy damping for generating the decoded audio signal portion.

41. A system according to claim 40, wherein the switching module is configured to determine whether or not at least one of the concealed audio signal frame and the succeeding audio signal frame comprises speech, and wherein the switching module is configured to choose the apparatus for implementing energy damping for generating the decoded audio signal portion, if the concealed audio signal frame and the succeeding audio signal frame do not comprise speech.

42. A system according to claim 40, wherein the switching module is configured to choose said one of the apparatus for implementing pitch adapt overlap and of the apparatus for implementing excitation overlap and of the apparatus for implementing energy damping for generating the decoded audio signal portion depending on a frame length of a succeeding audio signal frame and depending on at least one of a pitch of the concealed audio signal portion or a pitch of the succeeding audio signal portion, wherein the succeeding audio signal portion is an audio signal portion of the succeeding audio signal frame.

43. A method for improving a transition from a concealed audio signal portion of an audio signal to a succeeding audio signal portion of the audio signal, wherein the method comprises:

generating a decoded audio signal portion of the audio signal depending on a first audio signal portion and depending on a second audio signal portion, wherein the first audio signal portion depends on the concealed audio signal portion, and wherein the second audio signal portion depends on the succeeding audio signal portion, and outputting the decoded audio signal portion, wherein each of the first audio signal portion and of the second audio signal portion and of the decoded audio signal portion comprises a plurality of samples, wherein each of the plurality of samples of the first audio signal portion and of the second audio signal portion and of the decoded audio signal portion is defined by a sample position of a plurality of sample positions and by a sample value, wherein the plurality of sample positions is ordered such that for each pair of a first sample position of the plurality of sample positions and a second sample position of the plurality of sample positions, being different from the first sample position, the first sample position is either a successor or a predecessor of the second sample position, wherein generating the decoded audio signal comprises determining a first sub-portion of the first audio signal portion, such that the first sub-portion comprises fewer samples than the first audio signal portion, wherein generating the decoded audio signal portion is conducted using the first sub-portion of the first audio signal portion and using the second audio signal portion or a second sub-portion of the second audio signal portion, such that for each sample of two or more samples of the second audio signal portion, the sample position of said sample of the two or more samples of the second audio signal portion is equal to the sample position of one of the samples of the decoded audio signal portion, and such that the sample value of said sample of the two or more samples of the second audio signal portion is different from the sample value of said one of the samples of the decoded audio signal portion.

* * * * *